US010978798B2

(12) United States Patent
Kuhn et al.

(10) Patent No.: US 10,978,798 B2
(45) Date of Patent: Apr. 13, 2021

(54) DEVICE FOR REVERBERATION OF MODES

(71) Applicant: Fraunhofer-Gesellschaft zur Foerderung der angewandten Forschung e.V., Munich (DE)

(72) Inventors: Peter Kuhn, Duisburg (DE); Philip Schmidt, Attendorn (DE); Frederic Meyer, Erndtebrueck (DE); Gerd Vom Boegel, Wuelfrath (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/514,867

(22) Filed: Jul. 17, 2019

(65) Prior Publication Data

US 2020/0028255 A1 Jan. 23, 2020

(30) Foreign Application Priority Data

Jul. 18, 2018 (DE) ..... 10 2018 211 931.7

(51) Int. Cl.
*H01Q 1/52* (2006.01)
*H01Q 21/06* (2006.01)
(Continued)

(52) U.S. Cl.
CPC ..... *H01Q 1/528* (2013.01); *H01Q 1/2216* (2013.01); *H01Q 21/065* (2013.01); *H01Q 21/245* (2013.01)

(58) Field of Classification Search
CPC ..... H01Q 1/528; H01Q 1/2216; H01Q 1/526; H01Q 21/065; H01Q 21/245; H01Q 25/02
See application file for complete search history.

(56) References Cited

U.S. PATENT DOCUMENTS 6,032,127 A 2/2000 Schkolnick et al.
6,320,509 B1 11/2001 Brady et al.
(Continued)

FOREIGN PATENT DOCUMENTS

DE 10060800 A1 6/2002
DE 102006047356 B3 4/2008
(Continued)

OTHER PUBLICATIONS

Frederic Meyer, et al., "Effects of Ground Plane Truncations on the Array Behaviour of a Smart Antenna Terminal With Modular Architecture", International Conference on Antenna Technologies (ICAT), Ahmedabad, India, Feb. 21-24, 2005.

*Primary Examiner* — Raymond R Chai
(74) *Attorney, Agent, or Firm* — Michael A. Glenn; Perkins Coie LLP

(57) ABSTRACT

A device includes an antenna array with at least four antennas, wherein each antenna has its own feeder line terminal, wherein the feeder line terminals of antennas arranged directly adjacent to one another are geometrically offset from one another by 90° in each case. The device further includes a control device configured to feed the individual antennas via their respective feeder line terminals such that the antenna array exhibits different radiation patterns at different points in time. A first radiation pattern shows a polarized field distribution. According to the invention, a second radiation pattern exhibits an unpolarized field distribution.

17 Claims, 12 Drawing Sheets

(51) Int. Cl.
*H01Q 21/24* (2006.01)
*H01Q 1/22* (2006.01)

(56) References Cited

U.S. PATENT DOCUMENTS

| | | | | |
|---|---|---|---|---|
| 8,902,046 | B2 | 12/2014 | Torabi | |
| 2005/0156806 | A1 | 7/2005 | Ohta et al. | |
| 2006/0278706 | A1 | 12/2006 | Hatakeyama et al. | |
| 2010/0253587 | A1* | 10/2010 | Lindenmeier | H01Q 7/00 343/797 |
| 2011/0215978 | A1* | 9/2011 | Lindenmeier | H01Q 21/28 343/744 |
| 2012/0019364 | A1 | 1/2012 | Reichenbach et al. | |
| 2012/0032869 | A1* | 2/2012 | Hawkins | H01Q 9/045 343/857 |
| 2012/0306698 | A1* | 12/2012 | Warnick | H01Q 21/065 342/372 |
| 2016/0141754 | A1* | 5/2016 | Leyh | H01Q 13/00 342/372 |
| 2016/0372836 | A1* | 12/2016 | Ashrafi | H01Q 15/0033 |
| 2019/0267710 | A1* | 8/2019 | Jenwatanavet | H01Q 9/0407 |

FOREIGN PATENT DOCUMENTS

| | | | |
|---|---|---|---|
| DE | 202008011717 | U1 | 1/2010 |
| DE | 202011001809 | U1 | 4/2011 |
| DE | 102010020531 | A1 | 11/2011 |
| DE | 202010008162 | U1 | 11/2011 |
| DE | 102011000852 | A1 | 8/2012 |
| DE | 102014014628 | A1 | 3/2015 |
| DE | 102016208520 | A1 | 11/2017 |
| EP | 1622221 | A1 | 2/2006 |
| EP | 2117078 | B1 | 7/2017 |
| WO | 2015018902 | A1 | 2/2015 |

* cited by examiner

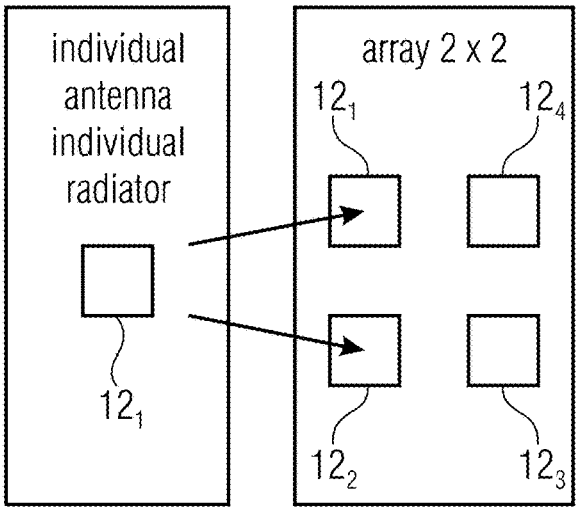
Fig. 2A
Fig. 2B
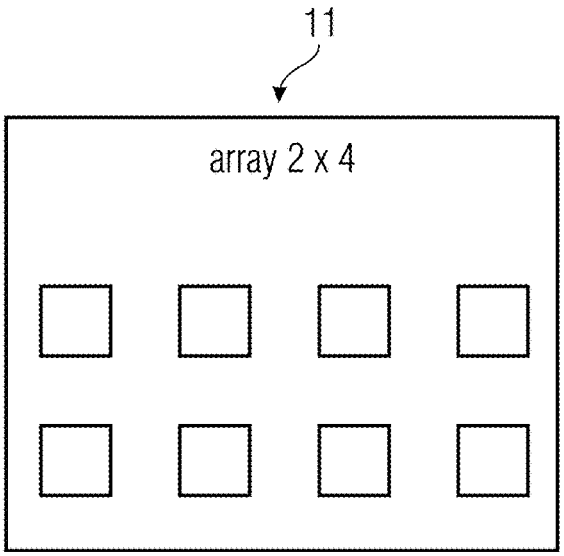
Fig. 2C
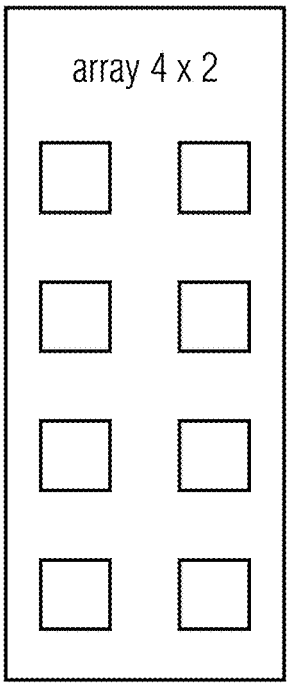
Fig. 2D
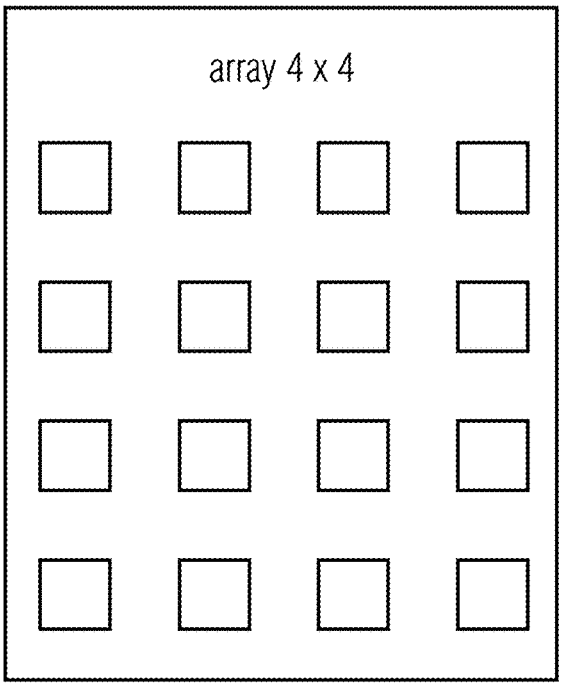
Fig. 2E

DEVICE FOR REVERBERATION OF MODES

CROSS-REFERENCES TO RELATED APPLICATIONS

This application claims priority from German Patent Application No. DE 10 2018 211 931.7, which was filed on Jul. 18, 2018, and is incorporated herein in its entirety by reference.

The invention relates to a device for reverberation of modes (mode stirring) which may form in the event of electromagnetic waves propagating within a shielded environment. In particular, the invention relates to a device for preventing the formation of standing waves, or a device for displacing standing waves, within a closed metallic environment, such as for example in a housing.

BACKGROUND OF THE INVENTION

In systems which can communicate wirelessly by means of electromagnetic waves, the receiving antenna and the transmitting antenna should be aligned for the purpose of good communication quality. So-called RFID systems (Radio Frequency Identification) can be referred to as examples of such systems.

For example, in order to increase the range or to save transmitting power and to reduce radiation emission, transmitting antennas exhibiting a linearly polarized field distribution can be used. This can be a vertical or horizontal polarization, for example. However, the receiving antennas should also be aligned to the same linear polarization. This means, in RFID systems, for example, the transponders should take a certain orientation in space so that they can receive the polarized waves reasonably. However, precisely in such RFID systems, the transponders are usually distributed chaotically or disorderly in space. As an example, one could imagine goods equipped with transponders in a supermarket, where the customer usually places the goods in his shopping cart regardless of the orientation of the respective goods.

In order to deal with this situation, in systems which can communicate with each other by means of electromagnetic waves, a circular polarization is used instead of a linear one. This means, the transmitting antenna emits circular polarized waves. As the name already indicates, these waves propagate circularly or helically in space. The advantage is that the receiving antenna (e.g. RFID transponder) can receive the transmitted circularly polarized wave independently of its orientation in space.

Linear and circular polarizations are idealized extreme examples of a possible polarization of waves. In reality, there will usually arise a mixture of both polarizations, which is generally referred to as an elliptical polarization. Therefore, the term elliptical polarization used herein includes both linear and circular polarization.

Such radio communication systems are used, for example, in the clinical environment of hospitals for identification and counting, or for cleaning and disinfecting surgical instruments. Thereby, surgical instruments equipped with transponders are sterilized for example in a so-called autoclave. These autoclaves are usually made of stainless steel and therefore form a shielding against electromagnetic waves.

Within such a shielded, especially metallic, environment, as for example in a sterilization chamber (autoclave) for surgical instruments, or also in an oven, in tunnel gates or the like, standing waves, so-called modes, form when using electromagnetically coupled systems, as for example in RFID systems. The form of the modes is determined by the basic conditions under which the wave propagates. This means, the form of the modes on the one hand depends on the frequency or wavelength and on the other hand on the form and dimensions of the space within which the wave propagates.

In view of this, the modes, within the space in which they form, exhibit local maxima and minima. Within the minima, the field strength of the emitted electromagnetic wave is zero, or almost zero. Accordingly, in RFID systems, for example, transponders located at positions where a field strength minimum prevails, cannot be supplied with energy and be read out.

To address this problem, several solutions have already been proposed aimed at changing the spatial position of the maxima and minima. This is also referred to as shifting or reverberation of modes. For this purpose, several spatially separated antennas are connected through one after the other, or the transmitting antenna is pivoted or rotated relative to the receiving antenna. Other solutions according to conventional technology provide for reflectors to be arranged in different orientations within the space in which the electromagnetic waves propagate. These known solutions in fact lead to an adequate reverberation of modes. However, these well-known systems exhibit many individual components that have to be aligned with each other, which leads to a complex structure and thus to high production costs.

It would therefore be desirable to improve devices for the reverberation of modes to such an extent that they can be produced by simple means and thus at low cost, while at the same time allowing good reverberation of modes that may form when the device is used.

Therefore, a device with the features of claim 1 is proposed. In addition, an RFID reader with such a device and a system with such a device and a three-dimensional body (e.g. a housing) with a recess in which electromagnetic waves can propagate are proposed. Embodiments and other advantageous aspects of the device according to the invention are mentioned in the respective dependent claims.

SUMMARY

According to an embodiment, a device may have: an antenna array including at least four antennas arranged to be offset from one another, each antenna including a feeder line terminal of its own, wherein the feeder line terminals of antennas which are arranged to be directly adjacent to one another exhibit a mutual geometric offset of 90°, respectively, a control device configured to feed the individual antennas via their respective feeder line terminals, so that the antenna array exhibits different radiation patterns at different points in time, a first radiation pattern including a polarized field distribution, and a second radiation pattern including an unpolarized field distribution.

According to another embodiment, an RFID-reader may have the inventive device.

According to another embodiment, a system may have: the inventive device and a three-dimensional body exhibiting at least one recess which defines a space within which the electromagnetic waves emitted by the antenna array propagate.

The device according to the invention exhibits an antenna array, among other things. The antenna array includes at least four individual antennas arranged to be spatially offset from one another. Each antenna has its own feeder line terminal, also known as a port or feeder port. The individual feeder line terminals of the individual antennas are arranged relative to each other in such a way that the feeder line terminals of directly adjacent antennas are geometrically offset by 90° from one another. For example, the feeder line terminal of a first antenna is geometrically offset by 90° from the feeder line terminal of a directly adjacent second antenna. In other words, the feeder line terminals of all antennas are arranged to be geometrically offset from one another by 90°. Furthermore, a feeder signal can be applied to the individual antennas, which serves to feed the individual antennas. Thereby, the same feeder signals can be applied to each antenna, wherein the individual feeder signals applied to the respective feeder line terminals can each have a phase offset $\Delta\varphi$, for example of $\Delta\varphi=90°$, to directly adjacent feeder line terminals. This means that a first antenna can be fed with a first feeder signal, and a second antenna arranged directly adjacent can be fed with a second feeder signal, wherein the second feeder signal can have a phase offset $\Delta\varphi$, for example of $\Delta\varphi=90°$, relative to the first feeder signal. In other words, the feeder signals from immediately adjacent antennas can each have a relative phase offset $\Delta\varphi$, for example from $\Delta\varphi=90°$, to each other. The phase offset $\Delta\varphi$ can, for example, be achieved by varying the length of the feeder line of the respective antenna, which leads to different signal propagation times. A direct integration of the phase offset $\Delta\varphi$ into the feed network would also be conceivable. The antenna array can thus, for example, exhibit a fixed radiation pattern. In the case described above, for example, the antenna array would exhibit a fixed circularly polarized radiation pattern. The device in accordance with the invention also includes a control device. The control device is configured to feed the individual antennas via their respective feeder line terminals in such a way that the antenna array has different radiation patterns at different times. In other words, the control device can feed the individual antennas at a first point in time in a first configuration in which the antennas emit in such a way that the antenna array shows a first predetermined radiation pattern. At a second point in time, the control device can feed the individual antennas in a second configuration, in which the antennas emit such that the antenna array has a second predetermined radiation pattern. The first configuration and thus the first radiation pattern differ from the second configuration and the second radiation pattern. It should also be noted that the antennas are actively fed into both configurations. This means that the antennas are also active in both configurations. A configuration and a radiation pattern does not mean that the antennas are not fed and the antenna array is therefore inactive, so that it does not emit any radiation. The radiation pattern described herein refers to an active radiation pattern of an antenna array with actively fed active antennas prevailing at the respective time. This means that the antenna array with the fed antennas actively emits electromagnetic radiation in its respective radiation patterns prevailing at the time. According to this definition, the first radiation pattern of the antenna array has a polarized field distribution. According to the invention, a second radiation pattern of the antenna array shows an unpolarized field distribution. This unpolarized field distribution is occasionally referred to here as a depolarized field distribution. The unpolarized or depolarized field distribution differs from the polarized field distributions described above in that their electromagnetic waves have no recognizable or preferred polarization. The control device can therefore switch the configuration of the power supply to the individual antennas back and forth between two points in time, so that the antenna array has a different field distribution at the first point in time than at the second point in time. Thus, the modes forming in a room shift so that also their minima and maxima shift spatially. This reverberation of modes ensures that field strengths with higher intensities prevail at positions in space where field strength minima were previously located. Thus, a receiving antenna can receive the electromagnetic wave at the same positions where no reception was possible before. Switching between two different radiation patterns of the antenna array offers a simple possibility for the reverberation of modes. At the same time, conventional antenna arrays with mutual feeder port arrangements can be used. However, the invention is based, among other things, on the fact that feeder configurations are used for these antenna arrays which are otherwise explicitly avoided in conventional technology. While conventional technology teaches to control this form of antenna array in such a way that the antenna array emits elliptically polarized waves, these antenna arrays according to the invention are controlled in such a way that the antenna array can deliberately emit a depolarized or unpolarized wave.

BRIEF DESCRIPTION OF THE DRAWINGS

Embodiments of the present invention will be detailed subsequently referring to the appended drawings, in which:

FIGS. 2A-2E show a schematic view of various possible arrangements of antennas on an antenna array for use in a device according to the invention based on an embodiment.

DETAILED DESCRIPTION OF THE INVENTION

Figure 1:
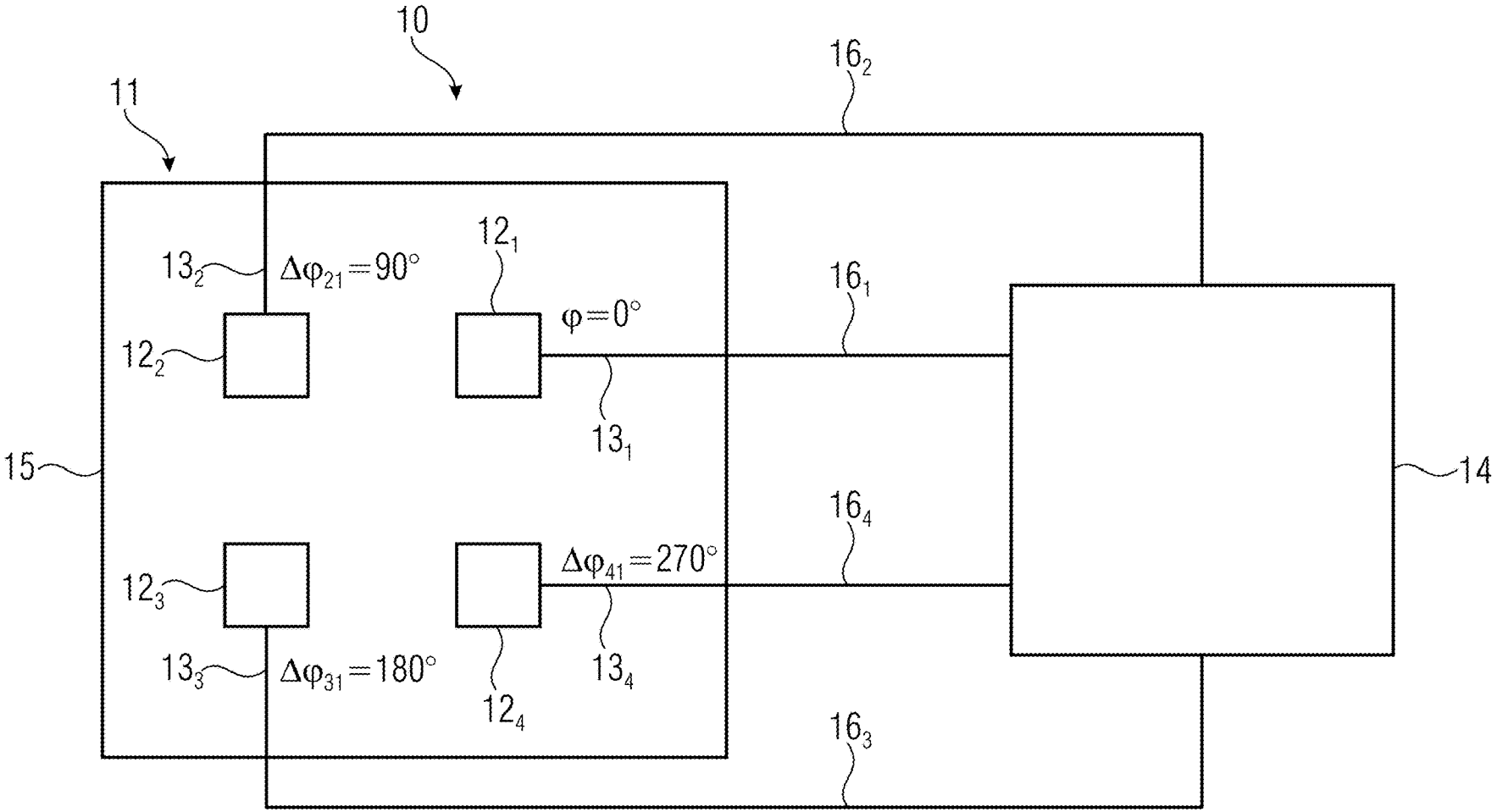
FIG. 1 shows a schematic view of a device according to the invention based on an embodiment.

In the following, embodiments will be described in more detail with reference to the Figures, wherein elements with the same or similar function are provided with the same reference signs.

In addition, radio waves are exemplarily described here as a non-limiting example for electromagnetic waves. The device according to the invention may advantageously be operated in frequency ranges between 30-500 kHz, and in particular at approximately 125 kHz, or between 3-30 MHz, and in particular at approximately 13.56 MHz, or between 400 MHz and 1000 MHz, and in particular at approximately 433 MHz, or approximately 868 MHz, or approximately 915 MHz, or approximately 950 MHz, or between 2 GHz and 30 GHz, and in particular at approximately 2.4-2.5 GHz, or at approximately 5.8 GHz.

Furthermore, individual antennas of an antenna array are described using the non-limiting example of patch antennas. However, it is also conceivable that other antenna geometries can be used alternatively or in addition to patch antennas.

Furthermore, a three-dimensional body comprising a recess is described using the non-limiting example of a housing with closed wall structures. However, it is also conceivable that the three-dimensional body may have other configurations, such as perforated wall structures, as in shopping baskets and shopping carts. In addition, the three-dimensional body can be closed or open at least in sections.

In addition, a metallic coating is described as a non-limiting example of a shielding to shield against electromagnetic radiation. However, other materials suitable for shielding electromagnetic radiation can also be used. In addition, a shielding should not necessarily be understood as the complete retention of electromagnetic radiation but at least as a reduction of electromagnetic radiation.

Insofar as it is referred to as a maximum in this document, this includes a tolerance range whose values are ±10% around the specified maximum value. If this document refers to a minimum, this includes a tolerance range whose values are ±10% around the specified minimum.

If this document refers to a phase, a phase position (phasing) or a phase offset with a specific numerical value, this includes a tolerance range whose values are ±10% around this numerical value.

FIG. 1 shows a schematic representation of a device 10 according to the invention based on an embodiment.

The device 10 exhibits an antenna array 11. The antenna array 11 exhibits at least four individual antennas $\mathbf{12}_1$, $\mathbf{12}_2$, $\mathbf{12}_3$, $\mathbf{12}_4$, which are arranged to be spatially offset from one another. In addition, the four individual antennas $\mathbf{12}_1$, $\mathbf{12}_2$, $\mathbf{12}_3$, and $\mathbf{12}_4$ are spaced apart from one another. The spatial distance between the individual antennas can be an integer or fractional rational multiple of the wavelength λ, i.e. n times A, with $n \in \mathbb{N}$.

The individual antennas $\mathbf{12}_1$, $\mathbf{12}_2$, $\mathbf{12}_3$, $\mathbf{12}_4$ are here exemplarily configured as patch antennas. However, other conventional antenna forms are also conceivable. The antennas $\mathbf{12}_1$, $\mathbf{12}_2$, $\mathbf{12}_3$, $\mathbf{12}_4$ can be arranged on a mutual substrate 15 and form an antenna array 11.

In the present example, a first antenna $\mathbf{12}_1$ is arranged at the top right of the antenna array 11. Starting from this first antenna $\mathbf{12}_1$, a second antenna $\mathbf{12}_2$, a third antenna $\mathbf{12}_3$, and a fourth antenna $\mathbf{12}_4$ are arranged counterclockwise.

Each antenna $\mathbf{12}_1$, $\mathbf{12}_2$, $\mathbf{12}_3$, $\mathbf{12}_4$ respectively has its own feeder line terminal $\mathbf{13}_1$, $\mathbf{13}_2$, $\mathbf{13}_3$, $\mathbf{13}_4$. The feeder line terminals $\mathbf{13}_1$, $\mathbf{13}_2$, $\mathbf{13}_3$, $\mathbf{13}_4$ of antennas $\mathbf{12}_1$, $\mathbf{12}_2$, $\mathbf{12}_3$, $\mathbf{12}_4$ arranged directly adjacent to one another are each arranged geometrically to be offset from one another by 90°. In other words, the feeder line terminals $\mathbf{13}_1$, $\mathbf{13}_2$, $\mathbf{13}_3$, $\mathbf{13}_4$ have a geometric angle difference of 90° to one another.

One feeder line each $16_1$, $\mathbf{16}_2$, $\mathbf{16}_3$, $\mathbf{16}_4$ is arranged at the feeder terminals $\mathbf{13}_1$, $\mathbf{13}_2$, $\mathbf{13}_3$, $\mathbf{13}_4$. A feeder signal for feeding the antennas $\mathbf{12}_1$, $\mathbf{12}_2$, $\mathbf{12}_3$, $\mathbf{12}_4$ can be applied to the feeder lines $\mathbf{16}_1$, $\mathbf{16}_2$, $\mathbf{16}_3$, $\mathbf{16}_4$, wherein the feeder signal is also referred to as simply a signal in the following. The signals applied to the respective feeder lines $\mathbf{16}_1$, $\mathbf{16}_2$, $\mathbf{16}_3$, $\mathbf{16}_4$ can have a preset relative phase offset Δφ with one another. This preset phase shift Δφ can be achieved by varying the length of the feeder lines $\mathbf{16}_1$, $\mathbf{16}_2$, $\mathbf{16}_3$, $\mathbf{16}_4$ (also referred to as conductor) of the respective antenna $\mathbf{12}_1$, $\mathbf{12}_2$, $\mathbf{12}_3$, $\mathbf{12}_4$, which leads to different signal propagation times. A direct integration of the phase offset Δφ into the feed network would also be conceivable.

For example, the feeder line $\mathbf{16}_1$ of the first antenna $\mathbf{12}_1$ can be defined as a reference line which defines a reference phase of $\varphi=0°$.

The second antenna $\mathbf{12}_2$ as well as the fourth antenna $\mathbf{12}_4$ each are arranged directly adjacent to the first antenna $\mathbf{12}_1$. In the present example, the feeder terminal $\mathbf{13}_2$ of the second antenna $\mathbf{12}_2$ is geometrically offset by 90° to the feeder terminal $\mathbf{13}_1$ of the first antenna $\mathbf{12}_1$. This means that the feeder terminal $\mathbf{13}_2$ of the second antenna $\mathbf{12}_2$ exhibits a geometric angle difference of 90° compared to the feeder terminal $\mathbf{13}_1$ of the first antenna $\mathbf{12}_1$. In addition to the geometric angle difference of 90°, in this embodiment, the signal fed in at the feeder terminal $\mathbf{13}_2$ of the second antenna $\mathbf{12}_2$ has a phase offset of $\Delta\varphi_{21}=90°$ compared to the signal fed in at the feeder terminal $\mathbf{13}_1$ of the first antenna $\mathbf{12}_1$ which represents the reference signal with the phase position $\Delta\varphi=0°$.

The third antenna $\mathbf{12}_3$ is arranged immediately adjacent to the second antenna $\mathbf{12}_2$. In the present example, the feeder terminal $\mathbf{13}_3$ of the third antenna $\mathbf{12}_3$ is geometrically offset by 90° to the feeder terminal $\mathbf{13}_2$ of the second antenna $\mathbf{12}_2$. This means that the feeder terminal $\mathbf{13}_3$ of the third antenna $\mathbf{12}_3$ exhibits a geometric angle difference of 90° compared to the feeder terminal $\mathbf{13}_2$ of the second antenna $\mathbf{12}_2$. In addition to the geometric angle difference of 90°, in this embodiment, the signal fed in at the feeder terminal $\mathbf{13}_3$ of the third antenna $\mathbf{12}_3$ has a phase offset of $\Delta\varphi=90°$ compared to the signal fed in at the feeder terminal $\mathbf{13}_2$ of the second antenna $\mathbf{12}_2$. In total, according to this, the feeder terminal $\mathbf{13}_3$ of the third antenna $\mathbf{12}_3$ exhibits a geometric angle difference of 180° with respect to the feeder terminal $\mathbf{13}_1$ of the first antenna $\mathbf{12}_1$, and the signal fed in at the feeder terminal $\mathbf{13}_3$ of the third antenna $\mathbf{12}_3$ exhibits a phase offset of $\Delta\varphi_{31}=180°$ compared to the reference signal with reference phase position $\varphi=0°$ fed in at the feeder terminal $\mathbf{13}_1$ of the first antenna $\mathbf{12}_1$.

The fourth antenna $\mathbf{12}_4$ is arranged directly adjacent to the third antenna $\mathbf{12}_3$. In the present example, the feeder terminal $\mathbf{13}_4$ of the fourth antenna $\mathbf{12}_4$ is geometrically offset by 90° to the feeder terminal $\mathbf{13}_3$ of the third antenna $\mathbf{12}_3$. This means that the feeder terminal $\mathbf{13}_4$ of the fourth antenna $\mathbf{12}_4$ has a geometric angle difference of 90° to the feeder terminal $\mathbf{13}_3$ of the third antenna $\mathbf{12}_3$. In addition to the geometric angle difference of 90°, in this embodiment, the signal fed in at the feeder terminal $13_4$ of the fourth antenna $12_4$ exhibits a phase offset of $\Delta\varphi_{43}=90°$ compared to the signal fed in at the feeder terminal $13_3$ of the third antenna $12_3$. Accordingly, the feeder terminal $13_4$ of the fourth antenna $12_4$ has a total geometric angle difference of 270° compared with the feeder terminal $13_1$ of the first antenna $12_1$, and the signal fed in at the feeder terminal $13_4$ of the fourth antenna $12_4$ has a phase offset of $\Delta\varphi_{41}=270°$ compared to the reference signal with reference phase position $\varphi=0°$ fed in at the feeder terminal $13_1$ of the first antenna $12_1$.

Since the fourth antenna $12_4$ is arranged directly adjacent to the first antenna $12_1$, the feeder terminal $13_4$ of the fourth antenna $12_4$ is geometrically offset by +270° to the feeder terminal $13_1$ of the first antenna $12_1$, which in turn is equivalent to a geometric angle difference of −90° and a phase offset of $\Delta\varphi_{14}=-90°$ compared to the reference signal with reference phase position $\varphi=0°$ fed in at the feeder terminal $13_1$ of the first antenna $12_1$.

The feeder line terminals $13_1$, $13_2$, $13_3$, $13_4$ of antennas $12_1$, $12_2$, $12_3$, $12_4$ arranged directly adjacent to one another are thus all arranged to be geometrically offset from one another in terms of amount by 90°.

In conclusion, the signals fed in at antennas $12_1$, $12_2$, $12_3$, $12_4$ arranged directly adjacent to one another can exhibit a preset phase offset of $\Delta\varphi=90°$, i.e. $\Delta\varphi=\pm90°$. This corresponds to a feeding configuration that results in a polarized radiation pattern.

A directly adjacent antenna is understood to be the antenna which has the smallest spatial distance to an observed antenna. For the first antenna $12_1$, for example, the second and fourth antennas $12_2$, $12_3$ would each be directly adjacent antennas, whereas the diagonally opposite third antenna $12_3$ has a greater spatial distance to the first antenna $12_1$ than the second and fourth antennas $12_2$, $12_4$ and thus does not represent a directly adjacent antenna.

The device 10 according to the invention further exhibits a control device 14. As will be explained in more detail below with reference to FIGS. 4A and 4B, the control device 14 can be configured as an analog component with phase actuators 41 and/or amplitude actuators 44 and corresponding switches 42, 43, or the control device 14 can be implemented digitally (FIG. 7), for example by means of digital signal processing 72 on an FPGA, ASIC, DSP or microcontroller and an analog front end 71 optionally arranged between the digital domain and the antenna array 11.

In each case, the control device 14 according to the invention is configured to feed the individual antennas $12_1$, $12_2$, $12_3$, $12_4$ via their respective feeder line terminals $13_1$, $13_2$, $13_3$, $13_4$ in different feeding configurations so that the antenna array 11 exhibits different radiation patterns at different points in time.

This means that the control device 14 provides a first feeding configuration at a first point in time, in which the antennas $12_1$, $12_2$, $12_3$, $12_4$ are controlled or fed in such a way that the antenna array 11 exhibits a first radiation pattern at this first point in time. At a second point in time, the control device 14 provides a second feeding configuration in which the antennas $12_1$, $12_2$, $12_3$, $12_4$ are controlled or fed in such a way that the antenna array 11 at this second point in time exhibits a second radiation pattern which is different from the first radiation pattern.

The first radiation pattern exhibits a polarized field distribution. This means that in the first feeding configuration, the antennas $12_1$, $12_2$, $12_3$, $12_4$ are controlled or fed in such a way that the antenna array 11 emits polarized waves. These can be elliptically polarized, i.e. linearly and/or circularly polarized waves, wherein the respective type of polarization depends on the respective type of the first feeding configuration, as will be explained in more detail later with reference to FIGS. 4A and 4B.

According to the invention, the second radiation pattern exhibits an unpolarized or depolarized field distribution. This means that in the second feeding configuration, the antennas $12_1$, $12_2$, $12_3$, $12_4$ are controlled or fed in such a way that the antenna array 11 emits unpolarized or depolarized waves. This will also be explained in detail later with reference to FIGS. 4A and 4B.

First, however, with reference to FIGS. 2A to 2E, as well as 3A and 3B, possible configurations of antenna arrays 11 are to be described, which can be used in the device 10 according to the invention.

FIG. 2A shows a single antenna $12_1$ which can also be referred to as single radiator.

FIG. 2B shows an antenna array 11, comparable to the antenna array 11 previously discussed with reference to FIG. 1. This is a 2×2 array on which two times two individual antennas $12_1$, $12_2$, $12_3$, $12_4$ are arranged.

FIG. 2C shows another embodiment of an antenna array 11. This is a 2×4 array on which a total of eight individual antennas are arranged, wherein four individual antennas each are arranged in two parallel rows.

FIG. 2D shows another embodiment of an antenna array 11. This is a 4×2 array on which a total of eight individual antennas are arranged, wherein four individual antennas are each arranged in two parallel columns.

FIG. 2E shows another embodiment of an antenna array 11. This is a 4×4 array on which a total of sixteen individual antennas are arranged, wherein four individual antennas are each arranged in four parallel rows or columns.

For the further description, the 2×2 arrangement, as discussed with reference to FIG. 1, is considered, since all other embodiments can be referred back to a parallelization of this 2×2 arrangement.

Figure 3A:
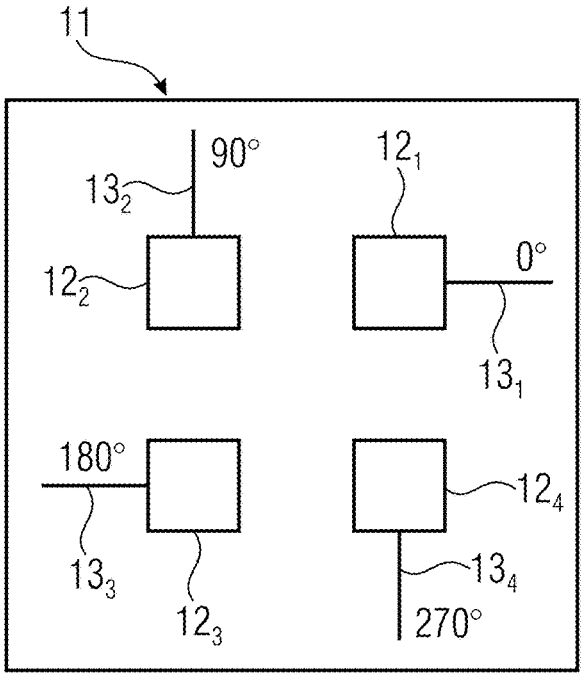
FIG. 3A shows a schematic view of an antenna array for use in a device according to the invention based on an embodiment
Figure 3B:
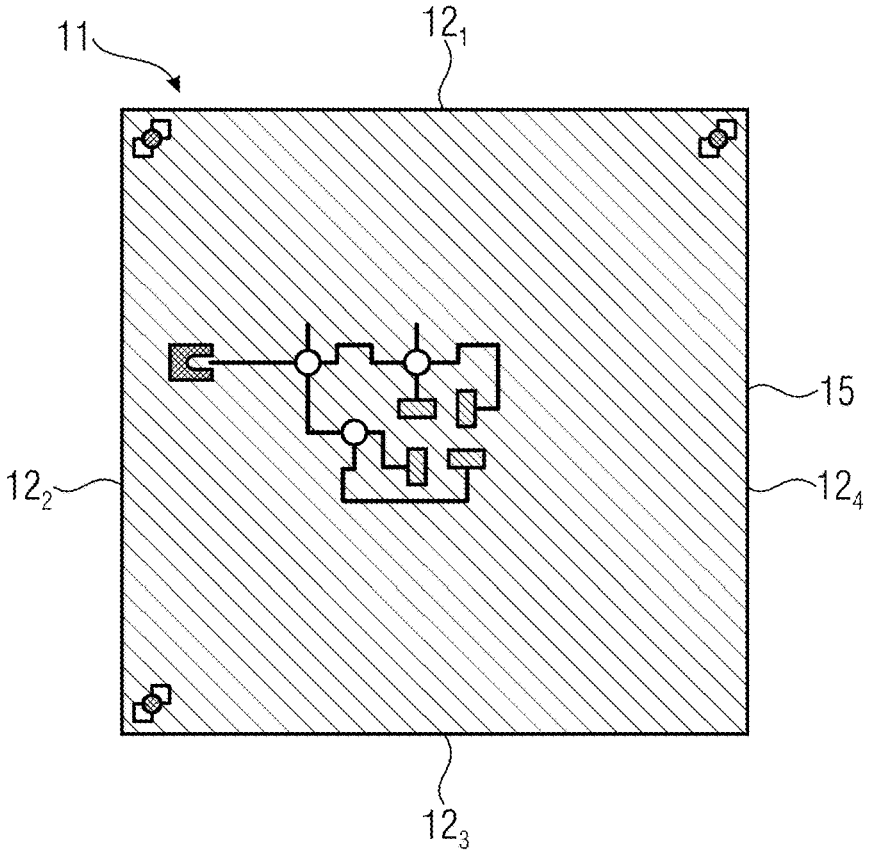
FIG. 3B shows a schematic view of an antenna array with a fixed feed network for use in a device according to the invention based on an embodiment.

FIG. 3A shows such a 2×2 array 11 with four individual antennas $12_1$, $12_2$, $12_3$, $12_4$, each with feeder terminals $13_1$, $13_2$, $13_3$, $13_4$ geometrically offset by 90° to each other. FIG. 3B shows a possible realization of a feed network with a fixed phase/amplitude setting which leads to a preset phase offset $\Delta\varphi$. This feed network exhibits a 2×2 antenna array 11 with four individual patch antennas $12_1$, $12_2$, $12_3$, $12_4$ on a mutual substrate 15.

Figure 4B:
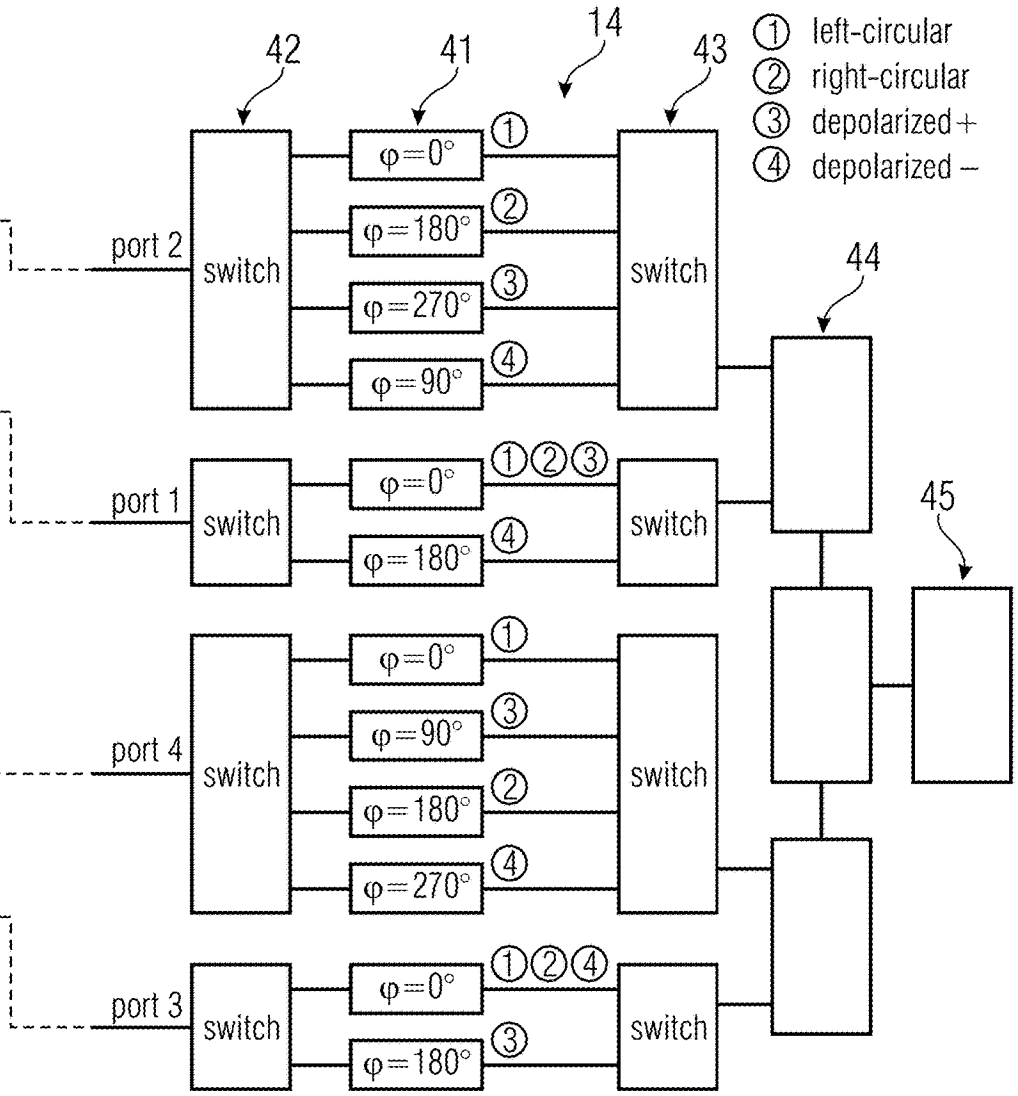
FIGS. 4A, 4B show a schematic view of an analog implementation of a control device for controlling an antenna array for use in a device according to the invention based on an embodiment.
Figure 4A:
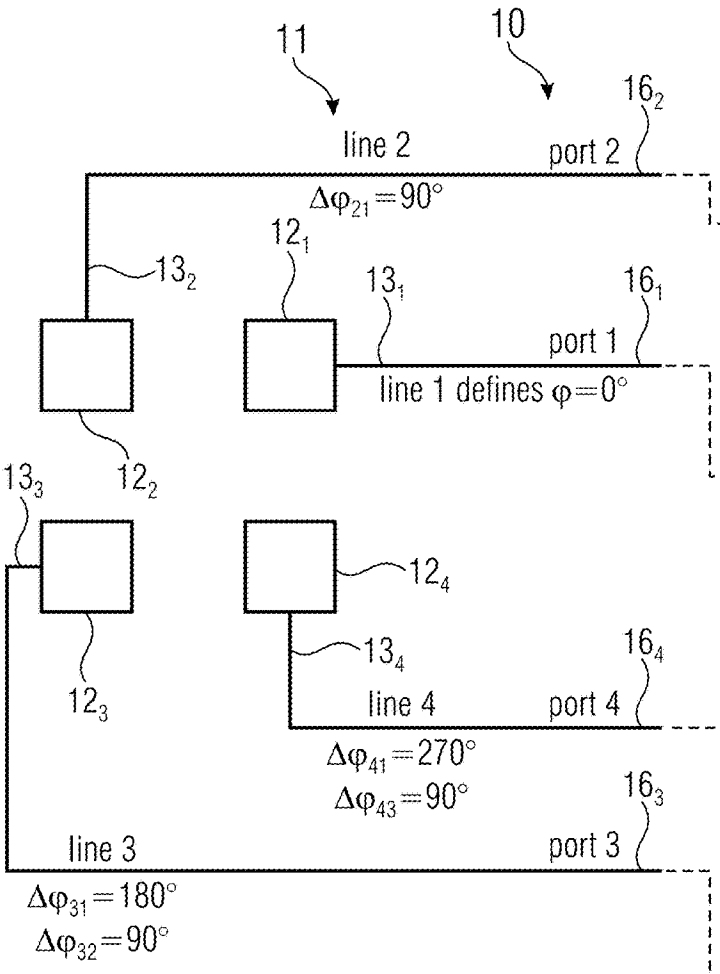

FIGS. 4A and 4B show a schematic block diagram of a control device 14 which can be used to provide the different feeding configurations mentioned above for the antenna array 11.

FIG. 4A exemplarily shows a feed network in which the individual antennas $12_1$, $12_2$, $12_3$, $12_4$ are fed in such a way that the signals fed in at directly adjacent antennas $12_1$, $12_2$, $12_3$, $12_4$ have a preset (e.g. due to the line length) phase offset of $\Delta\varphi=\pm90°$ to one another. In the 2×2 antenna array 11 shown, the feeder line $16_1$ of the first antenna $12_1$ defines the reference phase with phase position $\varphi=0°$. This means that the signal applied to the first antenna $12_1$ has a reference phase of $\varphi=0°$. The signal applied to the second antenna $12_2$ has a preset phase offset of $\Delta\varphi_{21}=90°$ compared to the signal applied to the first antenna $12_1$. Generally speaking, the individual signals that are fed to antennas arranged directly adjacent to each other have a preset phase offset of $\Delta\varphi=\pm90°$.

As already described above with reference to FIG. 1, the feeder terminal $13_2$ of the second antenna $12_2$ is arranged to be geometrically offset by 90° from the feeder terminal $13_1$ of the first antenna $12_1$, the feeder terminal $13_3$ of the third antenna $12_3$ is arranged to be geometrically offset by 180° from the feeder terminal $13_1$ of the first antenna $12_1$, and the feeder terminal $13_4$ of the fourth antenna $12_4$ is arranged to be geometrically offset by 270° from the feeder terminal $13_1$ of the first antenna $12_1$. The antennas which are arranged directly adjacent to each other, are arranged to be geometrically offset by 90° from one another, as discussed above with reference to FIG. 1.

FIG. 4B shows an exemplary analog configuration of the control device 14 which can be used to provide different feeding configurations. The control device 14 can thereby exhibit a number of ports corresponding to the number of feeder terminals $13_1$, $13_2$, $13_3$, $13_4$, wherein in each case one port can be connected to a feeder terminal $13_1$, $13_2$, $13_3$, $13_4$ of an antenna $12_1$, $12_2$, $12_3$, $12_4$ via one conductor or feeder line $16_1$, $16_2$, $16_3$, $16_4$, respectively. In the present example, port 1 is connected to the feeder terminal $13_1$ of the first antenna $12_1$, port 2 is connected to the feeder terminal $13_2$ of the second antenna $12_2$, port 3 is connected to the feeder terminal $13_3$ of the third antenna $12_3$, and port 4 is connected to the feeder terminal $13_4$ of the fourth antenna $12_4$.

In each branch or path associated with a port 1 to port 4, the control device 14 may have at least one phase actuator 41 and/or at least one amplitude actuator 44. The phase actuators 41 are used to set the phase position of the respective signal. Depending on the selected feeding configuration, the phase positions of the individual signals can be rotated by means of the phase actuators 41. The amplitude actuators 44 are used to set the amplitudes of the individual signals between each other to approximately the same signal level. This is advantageous because, for example, preset feed networks can have feeder lines of different lengths $16_1$, $16_2$, $16_3$, $16_4$ which can attenuate the signals to different degrees. By means of the amplitude actuators 44, the different attenuations can be compensated and the amplitudes of the individual signals can be adjusted to approximately the same level.

In the non-limiting example shown here, the control device 14 (from top to bottom) in the branch associated with port 2 exhibits four phase actuators (φ=0°, φ=90°, φ=180°, φ=270° and a corresponding amplitude actuator 44. In the branch associated with port 1, the control device 14 exhibits two phase actuators (φ=0°, φ=180° and a corresponding amplitude actuator 44. In the branch associated with port 4, the control device 14 exhibits four phase actuators (φ=0°, φ=90°, φ=180°, φ=270° and a corresponding amplitude actuator 44. In the branch associated with port 3, the control device 14 has two phase actuators (φ=0°, φ=180°) and a corresponding amplitude actuator 44.

A switch 42, 43 can be arranged in each branch upstream and downstream of the phase actuators 41. In addition, amplitude or power actuators 44 can be provided to adapt the amplitude or antenna power. Optionally, the control device 14 can comprise a reading device 45. This can be, for example, an RFID reader which can be integrated in the controt device 14 or at least can be coupled to the control device 14.

FIG. 4B on the upper right exemplarily shows different examples of feeding configurations in the form of encircled Arabic numerals ①②③④. As mentioned at the outset, the antennas $12_1$, $12_2$, $12_3$, $12_4$ are fed in a first feeding configuration in such a way that the antenna array 11 has a first radiation pattern exhibiting a field distribution with elliptical polarization. The paths ① and ② show examples of such a first feeding configuration.

According to the invention, the antennas $12_1$, $12_2$, $12_3$, $12_4$ are fed in a second feeding configuration in such a way that the antenna array 11 exhibits a second radiation pattern with a field distribution without polarization or with a positively or negatively depolarized field distribution. The paths ③ and ④ show examples of such a second feeding configuration.

Thus, in the first path ① the antennas $12_1$, $12_2$, $12_3$, $12_4$ are fed in such a way that the antenna array 11 has a field distribution with left circular polarization. As mentioned at the outset, the individual antennas $12_1$, $12_2$, $12_3$, $12_4$ are fed in such a way that the signals fed in at directly adjacent antennas $12_1$, $12_2$, $12_3$, $12_4$ have a preset phase offset of Δφ=±90° to each other (e.g. due to the line length). The first path ① provides a first feeding configuration in which the control device 14 does not execute a phase rotation of the signals. The result is, as an example only, a preset left circular polarization of the antenna array 11. Due to the preset relative phase offset of Δφ=±90° and no further phase rotation carried out by the control device 14, the individual signals fed in at the respective antennas $12_1$, $12_2$, $12_3$, $12_4$ thus have the preset phase offset of φ=+90° to one another.

In the second path ②, an alternative first feeding configuration is provided. Thereby, the antennas $12_1$, $12_2$, $12_3$, $12_4$ are fed in such a way that the antenna array 11 shows a field distribution with right circular polarization. Here, too, a left circular polarization of the antenna array 11 is preset (for example, only). However, in the second path ②, compared to the left circular polarization mentioned above, the phase positions of the signals applied to the second and fourth antenna $12_2$, $12_4$ are rotated by the control device 14 by φ=180° each. The individual signals fed in at the respective antennas $12_1$, $12_2$, $12_3$, $12_4$ thus have a relative phase offset of Δφ=−90° to one another.

This means that in the first feeding configuration (first path ① or second path ②), the individual signals fed into adjacent antennas $12_1$, $12_2$, $12_3$, $12_4$ have a phase offset of Δφ=90° to one another.

Instead of the circular polarizations exemplarily mentioned, linear polarizations can also be provided in the first feeding configuration. In general, circular and linear polarizations are summarized here under the term elliptical polarization. This means that both in the first path ① and in the second path ②, the antennas $12_1$, $12_2$, $12_3$, $12_4$ are fed in such a way that the antenna array 11 has a field distribution with elliptical polarization.

In the example shown here, the antenna array 11 exhibits a preset radiation pattern with left circular polarization, or more generally with an elliptical polarization.

The third path ③ and the fourth path ④ exemplarily represent two possibilities for a second feeding configuration and thus a part of the concept according to invention. Here, the individual antennas $12_1$, $12_2$, $12_3$, $12_4$ are fed in such a way that the previously described preset elliptical polarization is compensated with a preset phase offset of Δφ=90°. In other words, the individual antennas $12_1$, $12_2$, $12_3$, $12_4$ are fed in such a way that the antenna array 11 is deliberately depolarized with elliptical polarization despite a preset radiation pattern. As described below based on a non-limiting example, phase rotations can be performed on one or more signals.

In an example of a second feeding configuration, according to the third path ③, for example the antennas $12_1$, $12_2$, $12_3$, $12_4$ are fed in such a way that the antenna array 11 has a positively depolarized or unpolarized field distribution. The preset phase offset of amount $\Delta\varphi=90°$ between adjacent antennas $\mathbf{12}_1$, $\mathbf{12}_2$, $\mathbf{12}_3$, $\mathbf{12}_4$ arranged directly adjacent to one another is compensated. In this example, the phases of those signals that have a preset phase offset $\Delta\varphi=0°$ compared to the reference phase $\varphi=0°$ are rotated in such a way that all signals in the result do not exhibit a phase offset $\Delta\varphi=0$ compared to the reference phase.

This means that the reference phase of $\varphi=0°$ of the signal fed in at the first antenna $\mathbf{12}_1$ remains in the third path ③. The phase of the signal fed in at the second antenna $\mathbf{12}_2$ has a preset phase offset of $\Delta\varphi_{21}=90°$ relative to the first antenna $\mathbf{12}_1$ and is therefore rotated by $\varphi=270°$. As a result, the signal fed in at the second antenna $\mathbf{12}_2$ does longer exhibit a phase offset ($\Delta\varphi=0°$) to the signal fed in at the first antenna $\mathbf{12}_1$ with the reference phase $\varphi=0°$. The phase of the signal fed in at the third antenna $\mathbf{12}_3$ has a preset phase offset of $\Delta\varphi31=180°$ relative to the first antenna $\mathbf{12}_1$ and is therefore rotated by $\varphi=180°$. As a resuit, the signal fed in at the third antenna $\mathbf{12}_3$ does no longer exhibit a phase offset ($\Delta\varphi=0°$ to the signal fed in at the first antenna $\mathbf{12}_1$ with the reference phase $\varphi=0°$. The phase of the signal fed in at the fourth antenna $\mathbf{12}_4$ has a preset phase offset of $\Delta\varphi_{41}=270°$ relative to the first antenna $\mathbf{12}_1$ and is therefore rotated by $\varphi=90°$. As a result, the signal fed in at the fourth antenna $\mathbf{12}_4$ does no longer exhibit a phase offset ($\Delta\varphi=0°$) to the signal fed in at the first antenna $\mathbf{12}_1$ with the reference phase $\varphi=0°$.

In another example of a second feeding configuration, according to the fourth path ④, the antennas $\mathbf{12}_1$, $\mathbf{12}_2$, $\mathbf{12}_3$, $\mathbf{12}_4$, for example, are fed in such a way that the antenna array 11 has an opposite, i.e. negatively depolarized or unpolarized, field distribution. Here, too, the preset phase offset of $\Delta\varphi=90°$ between antennas $\mathbf{12}_1$, $\mathbf{12}_2$, $\mathbf{12}_3$, $\mathbf{12}_4$ arranged directly adjacent to one another is compensated. In this example, however, the reference phase is rotated by $\varphi=180°$, i.e. the reference phase at port 1 is no longer $\varphi=0°$ but $\varphi=180°$. In addition, the phases of those signals that have a preset phase offset $\Delta\varphi$ compared to the reference phase $\varphi=180°$ are rotated in such a way that all signals no longer exhibit a phase offset $\Delta\varphi=0$ compared to the reference phase.

This means that the phase of $\varphi=0°$ of the signal fed in at the first antenna $\mathbf{12}_1$ is first rotated by 180° so that the new reference phase is $\varphi=180°$. The phase of the signal fed in at the second antenna $\mathbf{12}_2$ has a preset phase offset of $\Delta\varphi_{21}=90°$ relative to the first antenna $\mathbf{12}_1$ and is therefore rotated by $\varphi=90°$. As a result, the signal fed in at the second antenna $\mathbf{12}_2$ does no longer exhibit a phase offset ($\Delta\varphi=0$) to the signal fed in at the first antenna $\mathbf{12}_1$ with the reference phase $\varphi=180°$. The phase of the signal fed in at the third antenna $\mathbf{12}_3$ has a fixed preset phase offset of $\Delta\varphi_{31}=180°$ relative to the first antenna $\mathbf{12}_1$ and is therefore not rotated any further. As a result, the signal fed in at the third antenna $\mathbf{12}_3$ does no longer exhibit a phase offset ($\Delta\varphi=0$) to the signal fed in at the first antenna $\mathbf{12}_1$ with the reference phase $\varphi=180°$. The phase of the signal fed in at the fourth antenna $\mathbf{12}_4$ has a preset phase offset of $\Delta\varphi_{41}=270°$ relative to the first antenna $\mathbf{12}_1$ and is therefore rotated by $\varphi=270°$. As a result, the signal fed in at the fourth antenna $\mathbf{12}_4$ does no longer have a phase offset ($\Delta\varphi=0°$) to the signal fed in at the first antenna $\mathbf{12}i$ with the reference phase $\varphi=180°$.

The first radiation pattern is therefore an elliptical radiation pattern, and the second radiation pattern is a positively depolarized or a negatively depolarized radiation pattern.

According to the invention, the first radiation pattern (elliptical polarization) of the antenna array 11 can be preset, and the second radiation pattern (depolarized) of the antenna array 11 can be switched on by means of the control device 14 despite the preset of the first radiation pattern.

FIG. 4B shows the Arabic numbers ①②③④ of the respective feeding configurations at the respective phase actuators 41. For each example of the first and second radiation patterns described above, the respective configuration of the phase actuators 41 is indicated. The following table lists for each path the respective phase rotation of the respective feeder signal at each port relative to the reference signal $\varphi=0°$ which can be set by means of a phase actuator 41:

TABLE 1

| | Port 1 | Port 2 | Port 3 | Port 4 |
|---|---|---|---|---|
| ① Left circularly | $\varphi = 0°$ | $\varphi = 0°$ | $\varphi = 0°$ | $\varphi = 0°$ |
| ② Right circularly | $\varphi = 0°$ | $\varphi = 180°$ | $\varphi = 0°$ | $\varphi = 180°$ |
| ③ Depolarized+ | $\varphi = 0°$ | $\varphi = 270°$ | $\varphi = 180°$ | $\varphi = 90°$ |
| ④ Depolarized− | $\varphi = 180°$ | $\varphi = 90°$ | $\varphi = 0°$ | $\varphi = 270°$ |

As mentioned at the outset, in the first path ①, a variant of a first feeding configuration is provided which generates a left circular field distribution at the antenna array 11. The feeder signals applied to the respective feeder terminals $\mathbf{13}_1$, $\mathbf{13}_2$, $\mathbf{13}_3$, $\mathbf{13}_4$ each have a preset phase offset of $\Delta\varphi=\pm90°$ to one another. This results in a left circular field and the individual phase actuators 41 do not have to perform any further phase rotation in the first path ①, i.e. the phase angle of all phase actuators 41 in the first path ① is $\varphi=0°$.

Thus, according to such an embodiment, the control device 14 according to the invention can be configured to feed the individual antennas $\mathbf{12}_1$, $\mathbf{12}_2$, $\mathbf{12}_3$, $\mathbf{12}_4$ in a first feeding configuration in such a way that the antenna array 11 exhibits the first radiation pattern, wherein the control device 14 can be configured to feed each individual antenna $\mathbf{12}_1$, $\mathbf{12}_2$, $\mathbf{12}_3$, $\mathbf{12}_4$ with a respective feeder signal, wherein the feeder signals to be fed in at the respective antenna $\mathbf{12}_1$, $\mathbf{12}_2$, $\mathbf{12}_3$, $\mathbf{12}_4$ each have a preset phase offset of $\Delta\varphi=90°$ in terms of amount, i.e. $\Delta\varphi=\pm90°$.

In the second path ②, a further variant of a first feeding configuration is provided which generates a right circular field distribution at the antenna array 11. In the second path ②, the phases at ports 2 and 4 are now rotated by $\varphi=180°$ relative to the reference signal with $\varphi=0°$, and port 3 is controlled with a phase rotation of $\varphi=0°$ so that the third antenna $\mathbf{12}_3$ is controlled with the preset phase difference of $\Delta\varphi_{31}=180°$ relative to the reference signal $\varphi=0°$. This results in a right circular field. In the second path ②, the individual phase actuators 41 thus perform a phase rotation of $\varphi=180°$ (in comparison to the reference phase of $\varphi=0°$ of the reference signal fed in at the first antenna 121) at port 2 and port 4, respectively, at the feeder signal which is then fed in at the feeder terminals $\mathbf{13}_2$, $\mathbf{13}_4$ of the second and fourth individual antennas $\mathbf{12}_2$, $\mathbf{12}_4$. In other words, the feeder signals provided by the control device 14 which are fed into the second and fourth individual antennas $\mathbf{12}_2$, $\mathbf{12}_4$, each have a phase offset of $\Delta\varphi=180°$ compared to the reference phase of $\varphi=0°$ of the reference signal fed in at the first antenna $\mathbf{12}_1$, and the feeder signals provided by the control device 14 which are fed into the first and third individual antennas $\mathbf{12}_1$, $\mathbf{12}_3$, have a phase offset of respectively $\Delta\varphi=0°$ compared to the reference phase of $\varphi=0°$ of the reference signal fed in at the first antenna $\mathbf{12}_1$.

In this feeding configuration according to the second path ③, the feeder signals applied to the respective feeder terminals $13_1$, $13_2$, $13_3$, $13_4$ exhibit a relative phase offset of $\Delta\varphi=-90°$. Due to the phase rotation of $\varphi=180°$ of the signals fed in at the second and fourth antennas $12_2$, $12_4$, however, there occurs no left circular but a right circular field.

According to such an embodiment, the control device 14 according to the invention may also be configured to feed, in a first feeding configuration, the individual antennas $12_1$, $12_2$, $12_3$, $12_4$ in such a way that the antenna array 11 exhibits the first radiation pattern, wherein the control device 14 can be configured to feed each individual antenna $12_1$, $12_2$, $12_3$, $12_4$ with a respective feeder signal in such a way that the feeder signals fed in at the respective antenna $12_1$, $12_2$, $12_3$, $12_4$ each exhibit a phase offset of $\Delta\varphi=90°$, i.e. $\Delta\varphi=\pm 90°$.

In the third path ③, a variant of a second feeding configuration according to the invention is provided which generates a positively depolarized field distribution at the antenna array 11. In the third path ③, the individual phase actuators 41 perform a phase rotation on the feeder signals which are fed in at the feeder terminals $13_2$, $13_3$, $13_4$ of the second, third, and fourth individual antennas $12_2$, $12_3$, $12_4$ in order to compensate for the preset phase offset of $\Delta\varphi=90°$ to the respective adjacent antenna.

This means that the control device 14 is configured to rotate the phases of the respective signals in such a way that the signals fed in at the respective antenna $12_1$, $12_2$, $12_3$, $12_4$ no longer have any phase offset to one another. The preset phase offset $\Delta\varphi$ is therefore compensated.

According to such a configuration, the control device 14 according to the invention can be configured to feed, in a second feeding configuration, the individual antennas $12_1$, $12_2$, $12_3$, $12_4$ in such a way that the antenna array 11 has the second radiation pattern, wherein the control device 14 can be configured to feed each individual antenna $12_1$, $12_2$, $12_3$, $12_4$ with a respective feeder signal in such a way that the feeder signals fed to the respective antenna $12_1$, $12_2$, $12_3$, $12_4$ no longer exhibit any phase offset $\Delta\varphi$ to one another.

In the third path ③, the first line $16_1$ defines the reference phase $\varphi=0°$. By means of the control device 14, for example, the phase position of the signal at port 2 is rotated by $\varphi=270°$ in order to compensate for the preset phase offset of $\Delta\varphi_{21}=90°$ on the second line $16_2$ so that there is no longer any phase offset $\Delta\varphi$ to the reference phase $\varphi=0°$. The phase position of the signal at port 3 is rotated by $\varphi=180°$ to compensate the preset phase offset of $\Delta\varphi_{31}=180°$ at the third line $16_3$ so that in total there is no longer any phase offset $\Delta\varphi$ to the reference phase $\varphi=0°$. The phase position of the signal at port 4 is rotated by $\varphi=90°$ in order to compensate the preset phase offset of $\Delta\varphi_{41}=270°$ on the fourth line $16_4$ so that there is no longer any phase offset $\Delta\varphi$ to the reference phase $\varphi=0°$. In total, the signals fed in at the respective antennas no longer have a phase offset $\Delta\varphi$ due to the phase rotations mentioned above. The preset phase offset $\Delta\varphi$ is thus compensated.

In the fourth path ④, a further variant of a second feeding configuration according to the invention is provided which generates a negatively depolarized field distribution at the antenna array 11. In this case, the reference phase of the feeder signal fed in at the first antenna $12_1$ is rotated by $\varphi=180°$ compared to the second feeding configuration described above which generates a positively depolarized field distribution, i.e. the reference phase in this case is not $\varphi=0°$ but $\varphi=180°$. The phases of the other feeder signals which are used to feed the second, third, and fourth antennas $12_2$, $12_3$, $12_4$, are also rotated by $\varphi=180°$ compared to the positive depolarization described above.

Also here in the fourth path ④, the individual phase actuators 41 perform a phase rotation at the feeder signals which are fed in at the feeder terminals $13_2$, $13_3$, $13_4$ of the second, third, and fourth individual antennas $12_2$, $12_3$, $12_4$ in order to compensate the preset phase offset of $\Delta\varphi=90°$ to the respective adjacent antenna.

This means that the control device 14 is configured to rotate the phases of the respective signals in such a way that the signals fed in at the respective antenna $12_1$, $12_2$, $12_3$, $12_4$ no longer exhibit any phase offset $\Delta\varphi$ to one another. This means that the preset phase shift $\Delta\varphi$ is compensated.

In the fourth path ④, for example, the control device 14 rotates the phase position of the signal at port 1 by $\varphi=180°$, which represents the new reference phase. The phase position of the signal at port 2 is rotated by $\varphi=90°$ so that in total there is no longer any phase offset $\Delta\varphi$ to the reference phase $\varphi=180°$. The phase position of the signal at port 3 is not rotated so that there is no longer any phase offset $\Delta\varphi$ to the reference phase $\varphi=180°$. The phase position of the signal at port 4 is rotated by $\varphi=270°$ so that in total there is no phase offset $\Delta\varphi$ to the reference phase $\varphi=180°$. In summary, the signals fed in at the respective antennas no longer exhibit any phase offset $\Delta\varphi$ due to the phase rotations mentioned above.

According to such an embodiment, the control device 14 according to the invention can thus be configured to feed the individual antennas $12_1$, $12_2$, $12_3$, $12_4$ in a second feeding configuration in such a way that the antenna array 11 has the second radiation pattern, wherein the control device 14 can be configured to feed each individual antenna $12_1$, $12_2$, $12_3$, $12_4$ with a feeder signal in each case in such a way that the feeder signals fed in at the respective antenna $12_1$, $12_2$, $12_3$, $12_4$ do not have any phase offset $\Delta\varphi$. The preset phase offset $\Delta\varphi$ is thus compensated.

In summary, it can therefore be stated that the control device 14 according to the invention can be configured to rotate the phases of the individual feeder signals, with which the individual antennas $12_1$, $12_2$, $12_3$, $12_4$ are each fed, despite a preset relative phase offset $\Delta\varphi$(e.g. due to the length of the respective feeder lines $16_1$, $16_2$, $16_3$, $16_4$), in such a way that the feeder signals no longer exhibit a phase offset to one another. The preset phase offset $\Delta\varphi$ is thus compensated.

Thus, based on the concrete example shown in FIGS. 4A and 4B, in such an embodiment, the control device 14 according to the invention can be configured to feed in the second feeding configuration the individual antennas $12_1$, $12_2$, $12_3$, $12_4$ in such a way that, relative to a reference phase of $\varphi=0°$

- the phase position of the feeder signal fed into the first antenna $12_1$ is not rotated,
- the phase position of the feeder signal fed into the second antenna $12_2$ is rotated by a phase angle of $\varphi=270°$,
- the phase position of the feeder signal fed into the third antenna $12_3$ is rotated by a phase angle of $\varphi=180°$, and
- the phase position of the feeder signal fed into the fourth antenna $12_4$ is rotated by a phase angle of $\varphi=90°$.

This second feeding configuration results in a second radiation pattern with a positively depolarized field. A radiation pattern with a negatively depolarized field can be achieved with an alternative second feeding configuration in which the control device 14 according to the invention is configured to feed the individual antennas $12_1$, $12_2$, $12_3$, $12_4$ in this alternative second feeding configuration in such a way that, relative to a reference phase of $\varphi=180°$ the phase position of the feeder signal fed into the first antenna $12_1$ is rotated by a phase angle of $\varphi=180°$, the phase position of the feeder signal fed into the second antenna $12_2$ is rotated by a phase angle of $\varphi=90°$, the phase position of the feeder signal fed into the third antenna $12_3$ is not rotated, and the phase position of the feeder signal fed into the fourth antenna $12_4$ is rotated by a phase angle of $\varphi=270°$.

Thus, according to the invention, the phase difference $\Delta\varphi$ of the feed network which is preset at the respective feeder terminals $13_1$, $13_2$, $13_3$, $13_4$ is compensated. This preset phase offset $\Delta\varphi$ is described here using the non-limiting example of $\Delta\varphi=90°$. The preset phase offset $\Delta\varphi$ which is also referred to as the phase difference $\Delta\varphi$ can generally have other values.

Figure 10B:
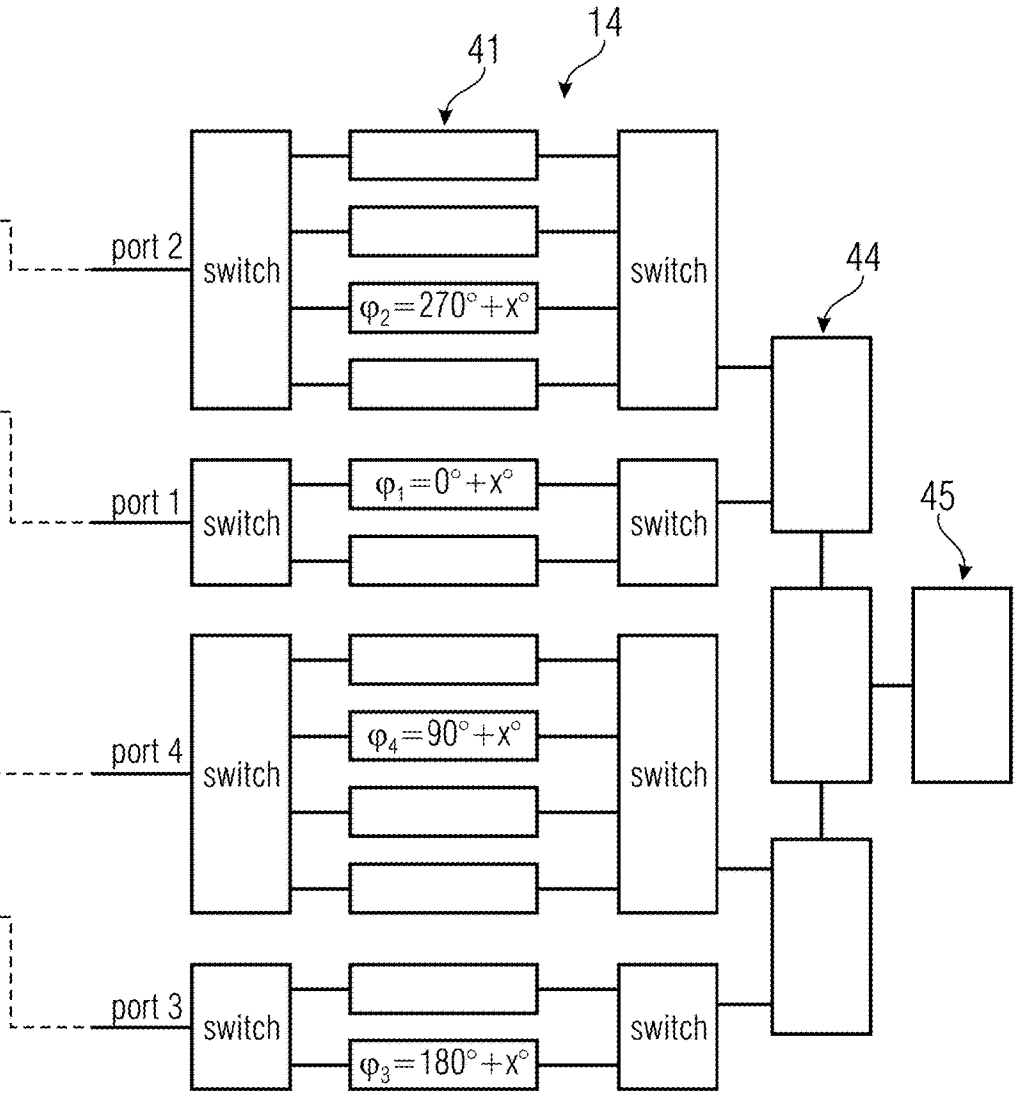
FIGS. 10A, 10B show a schematic view of an implementation of a control device for controlling an antenna array for use in a device according to the invention based on an embodiment.
Figure 10A:
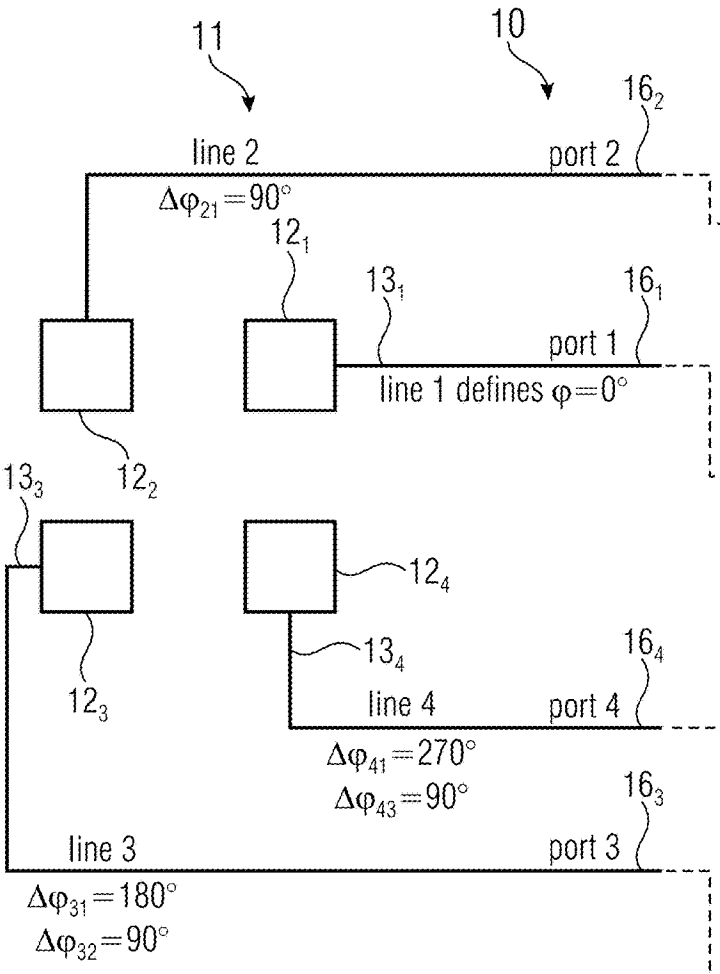

FIGS. 10A and 10B are similar to FIGS. 4A and 4B discussed above and show a general example for setting phase positions of individual feeder signals by means of the control device 14 to generate a second radiation pattern with depolarized field.

Again, the first line $16_1$ defines the reference phase with phase angle $\varphi=0°$. The control device 14 performs a phase rotation of the signal to be fed into the first antenna $12_1$ at port 1 by a phase angle $\varphi_1=0°$ plus an offset of $\varphi=x°$, i.e. $\varphi_1=0°+x°$. The control device 14 performs a phase rotation of the signal to be fed into the second antenna $12_2$ at port 2 by a phase angle $\varphi_2=270°$ plus the same offset of $\varphi=x°$, i.e. $\varphi_2=270°+x°$. The control device 14 performs a phase rotation of the signal to be fed into the third antenna $12_3$ at port 3 by a phase angle $\varphi_3=180°$ plus the same offset of $\varphi=x°$, i.e. $\varphi_3=180°+x°$. The control device 14 performs a phase rotation of the signal to be fed into the fourth antenna $12_4$ at port 4 by a phase angle $\varphi_4=90°$ plus the same offset of $\varphi=x°$, i.e. $\varphi_4=90°+x°$.

In order to obtain the second radiation pattern with the depolarized field distribution, the offset $\varphi=x°$ should have the same value at all antenna ports. Thereby, the offset value x: $0°\leq x\leq 360°$ applies.

Based on the concrete example shown in FIGS. 10A and 10B, in such an embodiment, the control device 14 according to the invention can thus be configured to feed the individual antennas $12_1$, $12_2$, $12_3$, $12_4$ in the second feeding configuration in such a way that, relative to a reference phase of $\varphi=0°$, the phase position of the feeder signal fed into the first antenna $12_1$ is rotated by an offset angle $\varphi=x°$, the phase position of the feeder signal fed into the second antenna $12_2$ is rotated by a phase angle of $\varphi=270°$ plus the same offset angle $\varphi=x°$, the phase position of the feeder signal fed into the third antenna $12_3$ is rotated by a phase angle of $\varphi=180°$ plus the same offset angle $\varphi=x°$, and the phase position of the feeder signal fed into the fourth antenna $12_4$ is rotated by a phase angle of $\varphi=90°$ plus the same offset angle $\varphi=x°$, wherein for the offset angle x the following applies: $0°\leq x\leq 360°$.

Accordingly, this describes a generally valid possibility for a second feeding configuration for generating a second radiation pattern with a depolarized field.

As mentioned at the outset, in contrast to this, there is a first feeding configuration for generating a first radiation pattern with a polarized field. Apart from the circular polarizations exemplarily mentioned above, with the control device 14 it is possible to provide further alternative first feeding configurations in which the antennas $12_1$, $12_2$, $12_3$, $12_4$ generate linearly polarized waves instead of the circularly polarized waves exemplarily mentioned. For clarity reasons, this possibility is not explicitly shown in FIGS. 4A and 4B. Linear polarization can be horizontally or vertically polarized waves.

As already mentioned at the outset, all polarization types are summarized here under the common term of elliptical polarization. All such initial feeding configurations leading to elliptic polarization exhibit the mutual feature that they have a field strength maximum at the center of the antenna array 11.

Figure 5A:
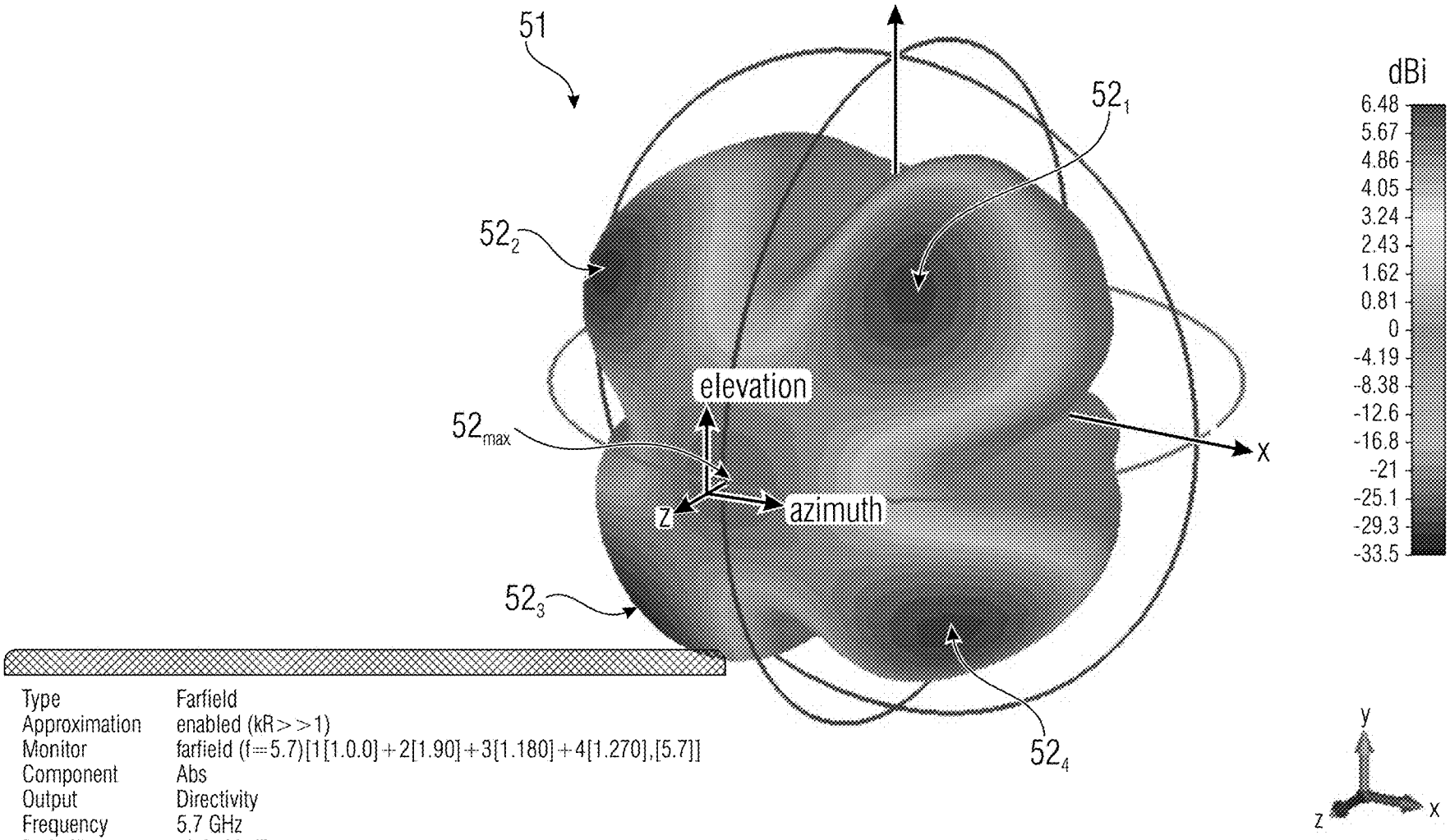
FIG. 5A shows a 3D plot of a far-field antenna pattern that results from a first feeding configuration.

This is clearly shown in FIG. 5A. Here, it can be seen an example of a 3D plot of a far-field antenna diagram 51 of a 2×2 antenna array 11, which was fed in a first feeding configuration in which the individual antennas $12_1$, $12_2$, $12_3$, $12_4$ of the array 11 generate linearly polarized waves.

Each individual antenna $12_1$, $12_2$, $12_3$, $12_4$ generates a respective field strength maximum of $52_1$, $52_2$, $52_3$, $52_4$ in the center of the respective individual antenna $12_1$, $12_2$, $12_3$, $12_4$ In the feeding configuration shown, however, a field strength maximum of $52_{Max}$ is formed in the center of the array 11 which results from a superposition of the field distribution of the individual antennas $12_1$, $12_2$, $12_3$, $12_4$ in the first feeding configuration.

Figure 5B:
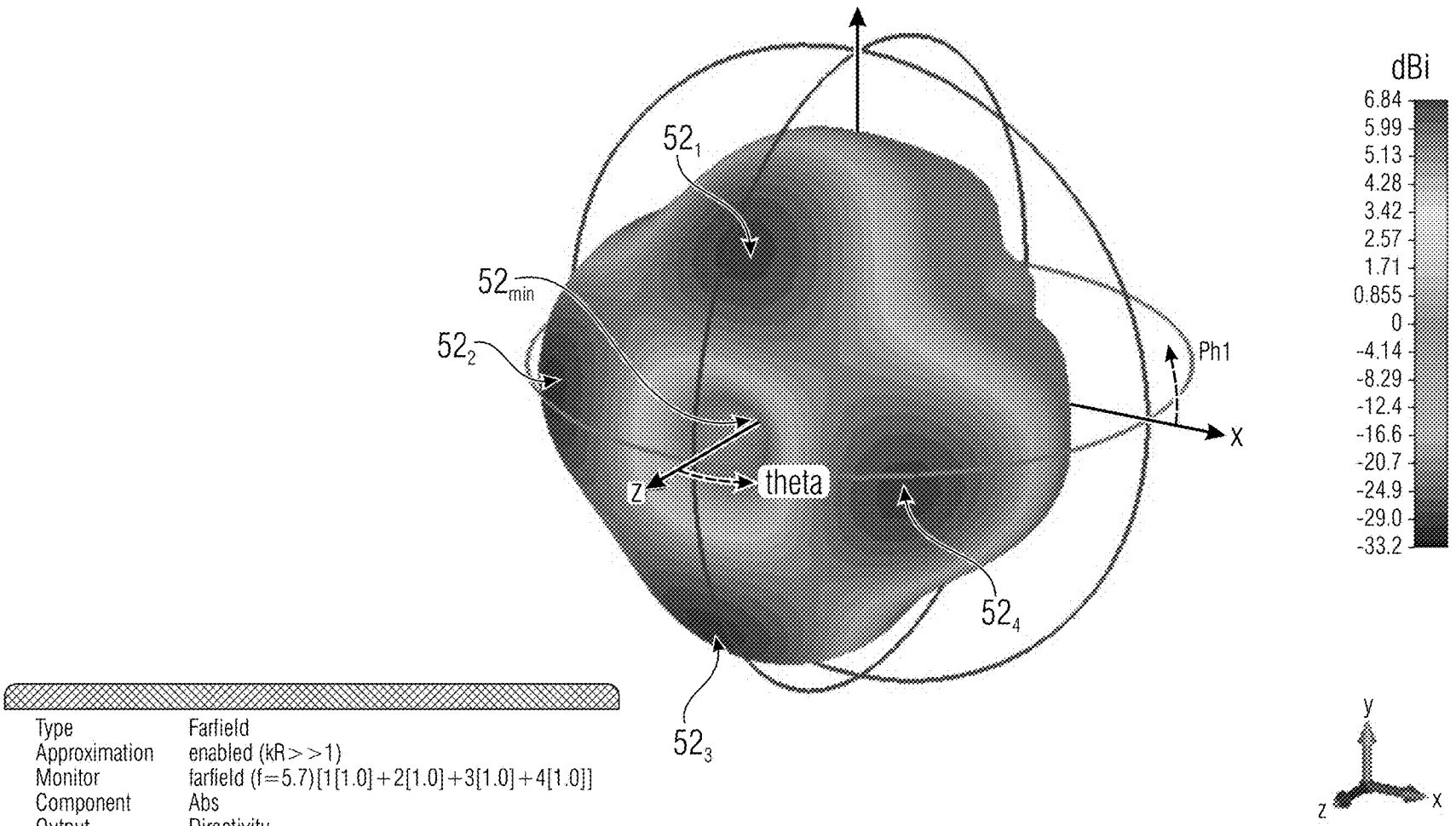
FIG. 5B shows a 3D plot of a far-field antenna pattern that results from a second feeding configuration.

FIG. 5B shows a second feeding configuration according to invention in which positive or negative depolarized waves form. Here again, each individual antenna $12_1$, $12_2$, $12_3$, $12_4$ generates a field strength maximum of $52_1$, $52_2$, $52_3$, $52_4$ in the center of each individual antenna $12_1$, $12_2$, $12_3$, $12_4$. In contrast to the first feeding configuration shown in FIG. 5A, the second feeding configuration shown in FIG. 5B results in a field strength minimum of $52_{Min}$ in the center of the antenna array 11.

According to such an embodiment, the first radiation pattern may exhibit a first field distribution with a maximum field strength of $52_{Max}$ at the center of the antenna array 11, and the second radiation pattern may exhibit a second field distribution with a minimum field strength of $52_{Min}$ at the center of the antenna array 11.

The case of minima and maxima described above represents an extreme example. In general, it is sufficient for the concept according to the invention if the first field distribution in the center of the antenna array 11 exhibits a different field strength than the second field distribution.

According to such an embodiment, the first radiation pattern may exhibit a first field distribution, and the second radiation pattern may exhibit a second field distribution, wherein the first field distribution at the center of the antenna array 11 exhibits a larger field strength, or alternatively a smaller field strength, than the second field distribution.

Figure 6A:
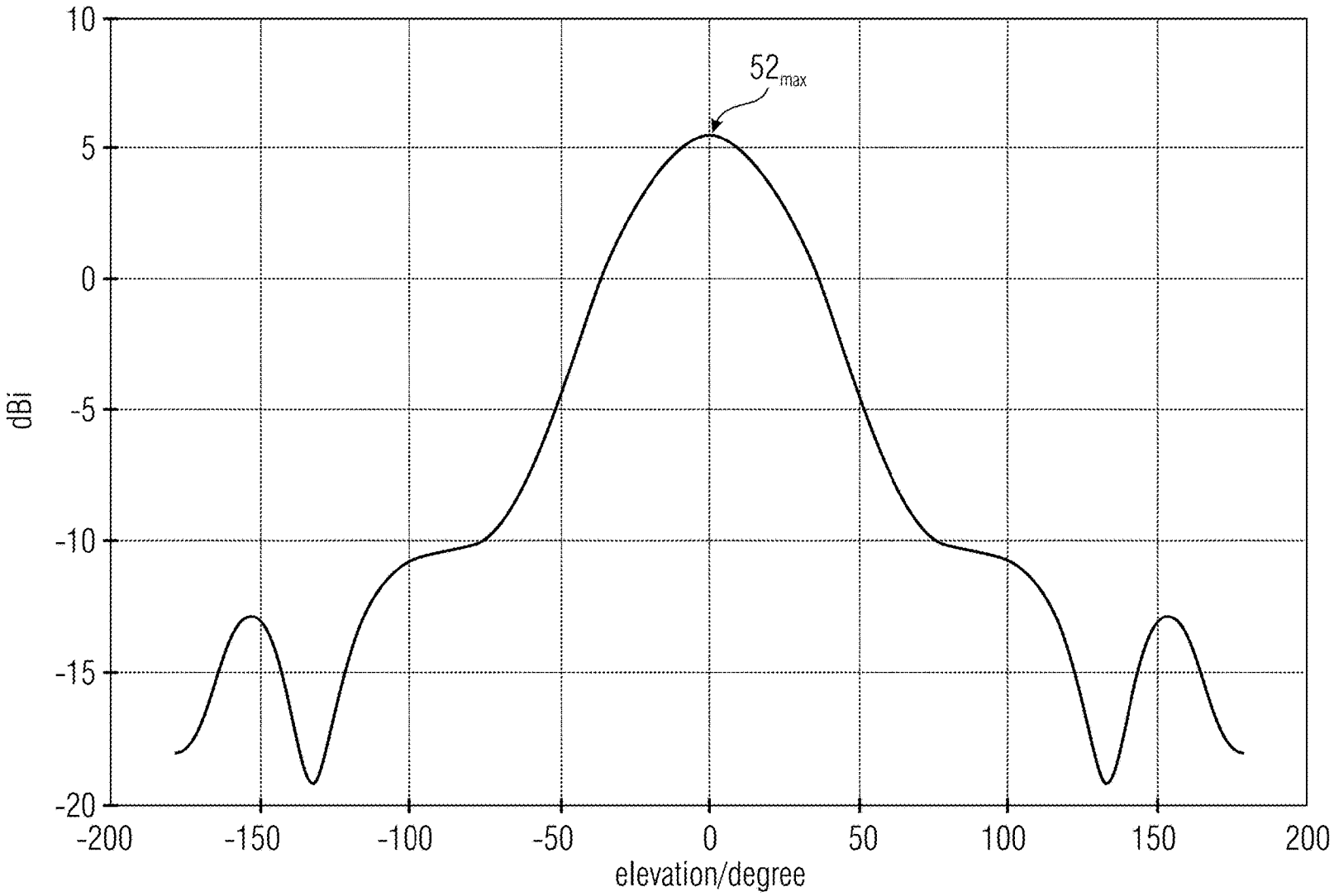
FIG. 6A shows a 2D section of the far-field antenna pattern from FIG. 5A.
Figure 6B:
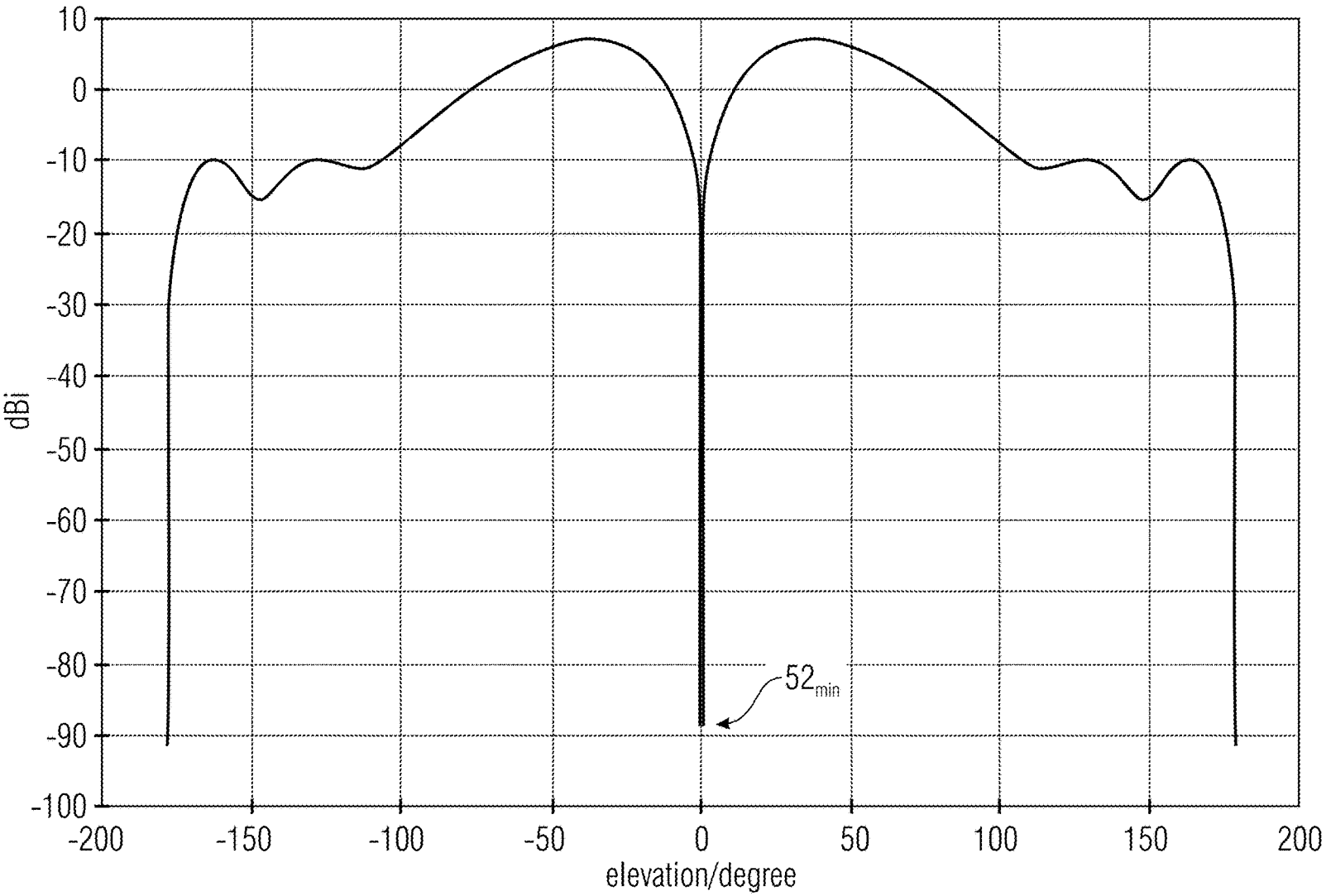
FIG. 6B shows a 2D section of the far-field antenna pattern from FIG. 5B.

For clarification, FIGS. 6A and 6B show 2D sections of the radiation patterns that occur in the respective feeding configurations. FIG. 6A shows a 2D section of the 3D plot from FIG. 5A. Here, it can be seen that with the first feeding configuration, which leads to polarized waves, a field strength maximum of $52_{Max}$ can be located in the center of the antenna array 11.

FIG. 6B on the other hand shows a 2D section of the 3D plot from FIG. 5B. Here, it can be seen that in the second feeding configuration according to the invention, which leads to positive or negative depolarized waves, a field strength minimum of $52_{Min}$ can be located in the center of the antenna array 11.

Figure 7:
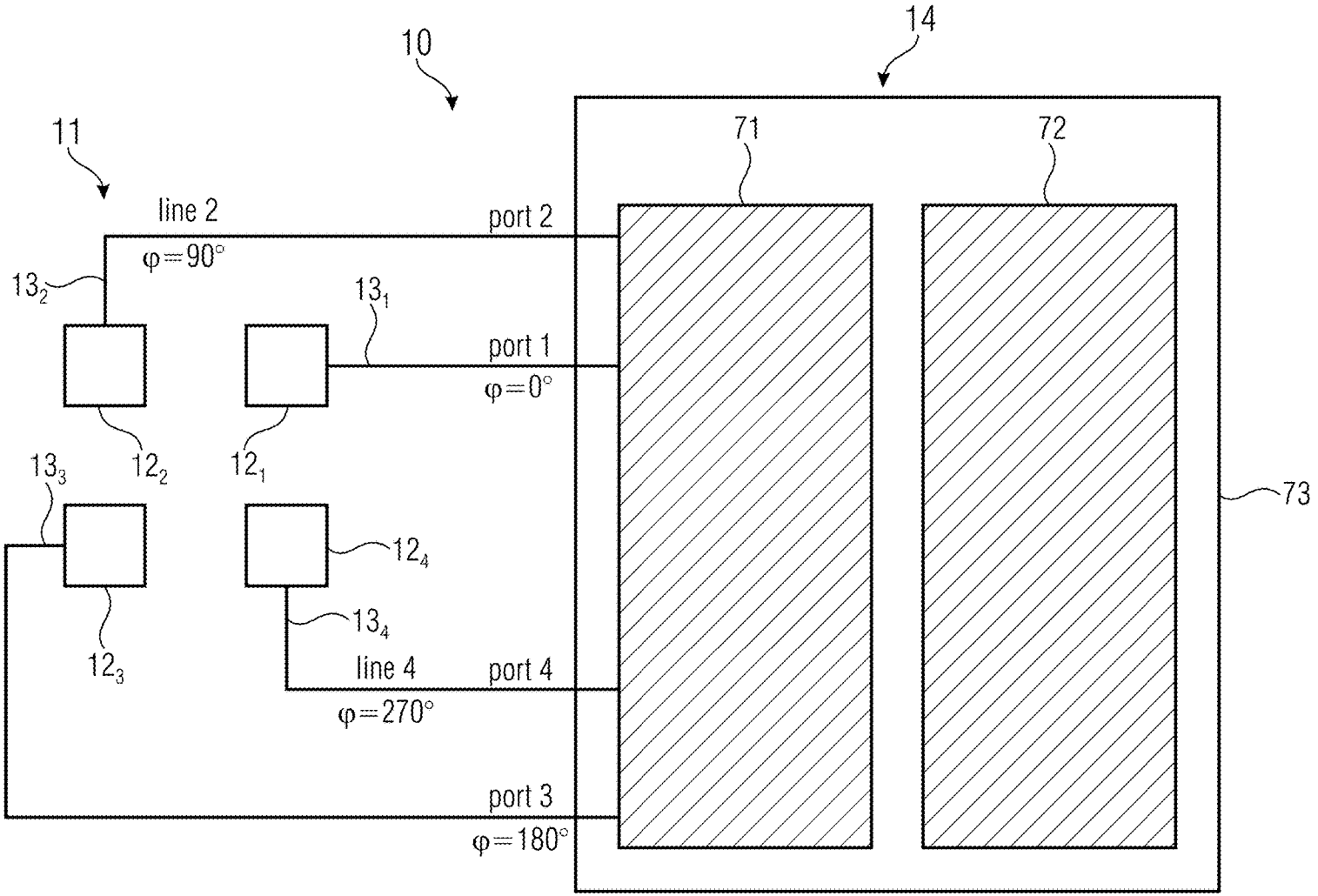
FIG. 7 shows a schematic view of a digital implementation of a control device for controlling an antenna array for use in a device according to the invention based on an embodiment.

FIG. 7 shows another embodiment of a device 10 according to the invention, however, in a possible exemplary digital realization. The device functionally corresponds essentially to the analog configuration described with reference to FIGS. 4A and 4B, which is why elements with the same or similar function are provided with the same reference signs. For its functional description, please refer to the above explanations.

The antenna array 11 is again exemplarily configured as a 2×2 array with four individual antennas $\mathbf{12}_1$, $\mathbf{12}_2$, $\mathbf{12}_3$, $\mathbf{12}_4$, wherein the feeder terminals $\mathbf{13}_1$, $\mathbf{13}_2$, $\mathbf{13}_3$, $\mathbf{13}_4$ of the individual antennas $\mathbf{12}_1$, $\mathbf{12}_2$, $\mathbf{12}_3$, $\mathbf{12}_4$ are geometrically offset by 90° from one another. The feeder terminal $\mathbf{13}_1$ of the first antenna $\mathbf{12}_1$ defines the reference phase of 0°.

The difference to the analog configuration according to FIGS. 4A and 4B is, among other things, that a digital processing unit 72, such as a microcontroller, an ASIC, an FPGA or a DSP, is provided which takes over the setting of the phases and amplitudes of the respective feeder signals in order to provide the different feeding configurations.

Furthermore, an analog frontend 71 can be provided between the antenna array 11 and the digital processing unit 72 for controlling the antenna array 11. The analog frontend 71 and the digital process unit 72 can be arranged mutually in a reader 73, for example in an RFID reader.

Irrespective of whether the control device 14 is digital, as shown in FIG. 7, or analog, as shown in FIGS. 4A and 4B, the control device 14 can be configured according to the invention to switch back and forth at least once between the two feeding configurations described above.

This means that the control device 14 provides the first feeding configuration described above at a first point in time, wherein the individual antennas $\mathbf{12}_1$, $\mathbf{12}_2$, $\mathbf{12}_3$, $\mathbf{12}_4$ are controlled or fed in a first time interval in such a way that the antenna array 11 emits polarized waves and a field strength maximum of $\mathbf{52}_{Max}$ can be generated in the center of the antenna array 11 (see FIG. 5A).

At a second point in time, the control device 14 provides the second feeding configuration described above according to the invention, wherein the individual antennas $\mathbf{12}_1$, $\mathbf{12}_2$, $\mathbf{12}_3$, $\mathbf{12}_4$ are controlled or fed in a second time interval in such a way that the antenna array 11 emits positively or negatively depolarized waves and a field strength minimum of $\mathbf{52}_{Min}$ can be generated at the center of the antenna array 11 (see FIG. 5B).

Accordingly, the first feeding configuration of the control device 14 thus results in a first radiation pattern of the antenna array 11 and the second feeding configuration of the control device 14 results in a second radiation pattern of the antenna array 11.

The control device 14 can also be configured to switch back and forth several times between the first and second feeding configurations.

Figure 8B:
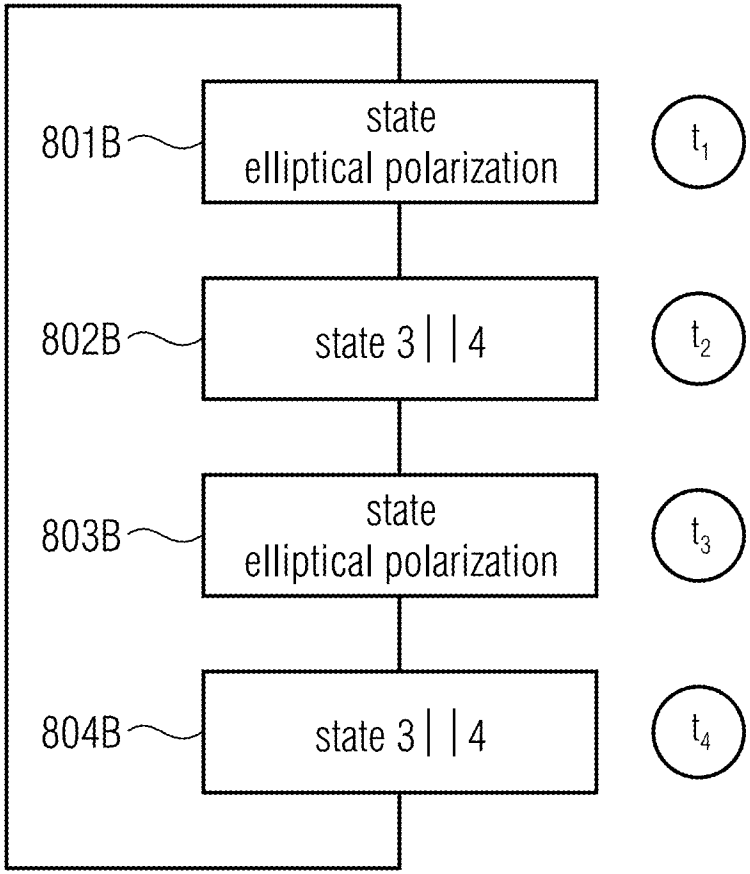
FIG. 8B shows a flowchart for representing switching back and forth between a first and a second power feeding configuration based on a further embodiment.
Figure 8A:
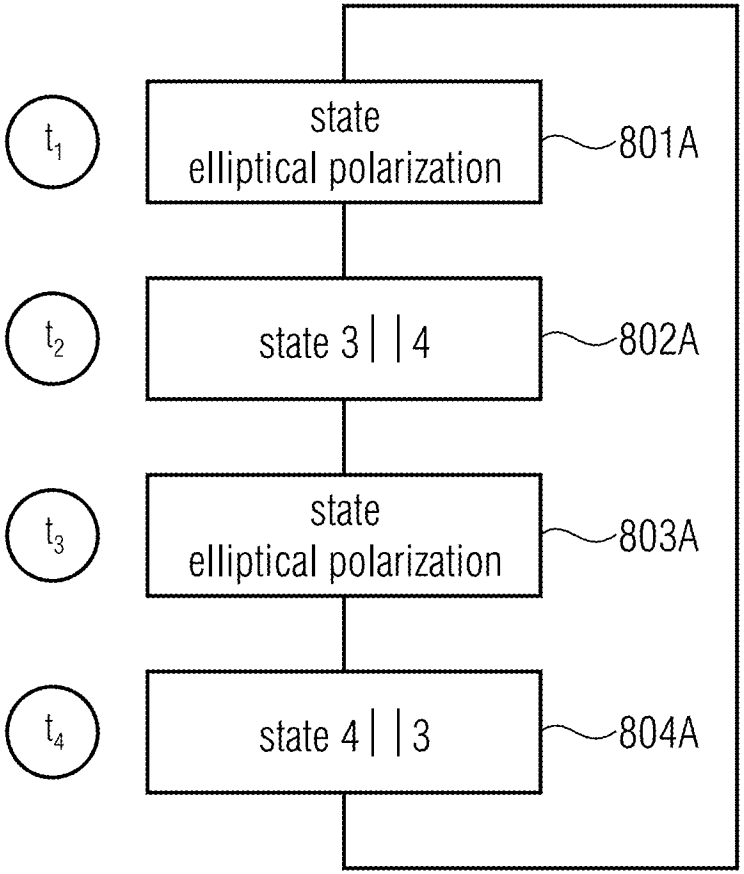
FIG. 8A shows a flowchart for representing switching back and forth between a first and a second feeding configuration based on an embodiment.

FIGS. 8A and 8B show two flow charts that illustrate the switching back and forth between different states, i.e. feeding configurations.

In FIG. 8A, in block 801A, a first feeding configuration is provided in a first time interval $t_1$ which results in an elliptical polarization. This means that in block 801A, a feeding configuration is provided in a first time interval $t_1$ in which the individual antennas $\mathbf{12}_1$, $\mathbf{12}_2$, $\mathbf{12}_3$, $\mathbf{12}_4$ are controlled or fed in such a way that the antenna array 11 emits polarized waves. Accordingly, the antenna array 11 exhibits the first radiation pattern (polarized) in this first time interval t1.

In block 802A, a second feeding configuration according to the invention is provided in a second time interval $t_2$. While keeping the nomenclature of FIGS. 4A and 4B, a second feeding configuration can be provided according to the third path ③ or alternatively according to the fourth path ④. In FIGS. 8A and 8B, this is referred to as state 3 or state 4. Accordingly, a second feeding configuration is provided in block 802A, in which the individual antennas $\mathbf{12}_1$, $\mathbf{12}_2$, $\mathbf{12}_3$, $\mathbf{12}_4$ are controlled or fed in such a way that the antenna array 11 emits positively depolarized (state 3) or negatively depolarized (state 4) waves according to the invention. This means that the antenna array 11 exhibits the second radiation pattern (positively or negatively depolarized) in this second time interval $t_2$.

In block 803A, in a third time interval $t_3$, a first feeding configuration is provided again in which the individual antennas $\mathbf{12}_1$, $\mathbf{12}_2$, $\mathbf{12}_3$, $\mathbf{12}_4$ are controlled or fed in such a way that the antenna array 11 emits polarized waves. This means that the antenna array 11 again exhibits the first radiation pattern (polarized) in this third time interval $t_3$.

In block 804A, in a fourth time interval $t_4$, a second feeding configuration according to the invention is again provided in which the individual antennas $\mathbf{12}_1$, $\mathbf{12}_2$, $\mathbf{12}_3$, $\mathbf{12}_4$ are controlled or fed in such a way that the antenna array 11 emits positively or negatively depolarized waves according to the invention. The difference to block 802A, however, is that block 804A provides the other signed depolarized second feeding configuration. This means that if a second feeding configuration is provided in block 802A resulting in positively depolarized waves (state 3), then a second feeding configuration is provided in block 804A resulting in negatively depolarized waves (state 4), and vice versa. This means that in this fourth time interval $t_4$, the antenna array 11 again exhibits the second radiation pattern (positively or negatively depolarized), however, with the opposite sign as in the second time interval $t_2$.

In FIG. 8B, in block 801B, a first feeding configuration is provided in a first time interval t1, which results in an elliptical polarization. This means that in block 801B, a feeding configuration is provided in a first time interval $t_1$ in which the individual antennas $\mathbf{12}_1$, $\mathbf{12}_2$, $\mathbf{12}_3$, $\mathbf{12}_4$ are controlled or fed in such a way that the antenna array 11 emits polarized waves. Accordingly, the antenna array 11 exhibits the first radiation pattern (polarized) in this first time interval In block 802B, a second feeding configuration according to the invention is provided in a second time interval $t_2$. While keeping the nomenclature of FIGS. 4A and 4B, a second feeding configuration can be provided according to the third path ③ or alternatively according to the fourth path ④. In FIGS. 8A and 8B, this is referred to as state 3 or state 4. Accordingly, a second feeding configuration is provided in block 802B, in which the individual antennas $\mathbf{12}_1$, $\mathbf{12}_2$, $\mathbf{12}_3$, $\mathbf{12}_4$ are controlled or fed in such a way that the antenna array 11 emits positively depolarized (state 3) or negatively depolarized (state 4) waves according to the invention. This means that the antenna array 11 exhibits the second radiation pattern (positively or negatively depolarized) in this second time interval $t_2$.

In block 803B, in a third time interval $t_3$, a first feeding configuration is provided again in which the individual antennas $\mathbf{12}_1$, $\mathbf{12}_2$, $\mathbf{12}_3$, $\mathbf{12}_4$ are controlled or fed in such a way that the antenna array 11 emits polarized waves. This means that the antenna array 11 again exhibits the first radiation pattern (polarized) in this third time interval $t_3$.

In block 804B, in a fourth time interval $t_4$, a second feeding configuration according to the invention is provided again in which the individual antennas $\mathbf{12}_1$, $\mathbf{12}_2$, $\mathbf{12}_3$, $\mathbf{12}_4$ are controlled or fed in such a way that the antenna array 11 emits positively or negatively depolarized waves according to the invention. The difference to FIG. 8A, however, is that both blocks 802B and 804B provide the same signed depolarized second feeding configuration. This means that if a feeding configuration is provided in block 802B resulting in positively depolarized waves (state 3), then a feeding configuration is also provided in block 804B resulting in positively depolarized waves (state 3). The same applies to negatively depolarized waves (state 4). This means that in this fourth time interval $t_4$, the antenna array 11 again exhibits the second radiation pattern (positively or negatively depolarized), but with the same sign as in the second time interval $t_2$.

Accordingly, the control device 14 is configured according to the invention to feed the individual antennas $\mathbf{12}_1$, $\mathbf{12}_2$, $\mathbf{12}_3$, $\mathbf{12}_4$ in a first time interval t1 in such a way that the antenna array 11 has the first radiation pattern (positively and negatively depolarized, respectively), and to feed the individual antennas $\mathbf{12}_1$, $\mathbf{12}_2$, $\mathbf{12}_3$, $\mathbf{12}_4$ in a second time interval $t_2$, in such a way that the antenna array 11 has the second radiation pattern (polarized), wherein the control device 14 is configured to switch back and forth at least once between the first and second feeding configurations and the first and second radiation patterns, respectively.

This switching back and forth between the first and the second radiation pattern (polarized vs. depolarized) or between the first and the second feeding configuration results in a shift of the minima and maxima of a forming mode. Thus, the reverberation of modes can be provided in a shielded space in which the waves propagate.

This switching back and forth can take place in different time intervals. In terms of temporal behavior, there are several possibilities: A) switching between the states so fast that no modes are formed, B) switching through so slowly that modes are formed and shifted with the new radiation pattern via switching, i.e. a reverberation of modes takes place. The modes forming in the first feeding configuration (positively or negatively depolarized) differ from the modes forming in the second feeding configuration (polarized).

According to a first conceivable embodiment, the control device can thus be configured to switch so quickly between the first and the second radiation pattern (or between the first and the second feeding configuration, respectively) that no modes are formed in a space surrounding the radiation of the antenna array 11.

According to a second conceivable embodiment, the control device 14 can be configured to switch so slowly between the first and the second radiation pattern (respectively between the first and the second feeding configuration) that modes are formed in a space surrounding the radiation of the antenna array 11, wherein the modes forming with the first radiation pattern differ from the modes forming with the second radiation pattern so that a reverberation of modes occurs in the space surrounding the radiation of the antenna array 11 due to the switching back and forth.

Alternatively or additionally, such a reverberation of modes can be generated by the control device 14 being configured to vary the frequency of a feeder signal coupled via the respective feeder line $\mathbf{13}_1$, $\mathbf{13}_2$, $\mathbf{13}_3$, $\mathbf{13}_4$ of a respective antenna $\mathbf{12}_1$, $\mathbf{12}_2$, $\mathbf{12}_3$, $\mathbf{12}_4$ within the bandwidth of the respective antenna $\mathbf{12}_1$, $\mathbf{12}_2$, $\mathbf{12}_3$, $\mathbf{12}_4$.

Furthermore, alternatively or additionally, the control device 14 may be arranged to selectively deactivate one or more antennas $\mathbf{12}_1$, $\mathbf{12}_2$, $\mathbf{12}_3$, $\mathbf{12}_4$ of the antenna array 11 in a first time interval $t_1$, and to reactivate one or more of the deactivated antennas $\mathbf{12}_1$, $\mathbf{12}_2$, $\mathbf{12}_3$, $\mathbf{12}_4$ in a second time interval $t_2$.

Figure 9A:
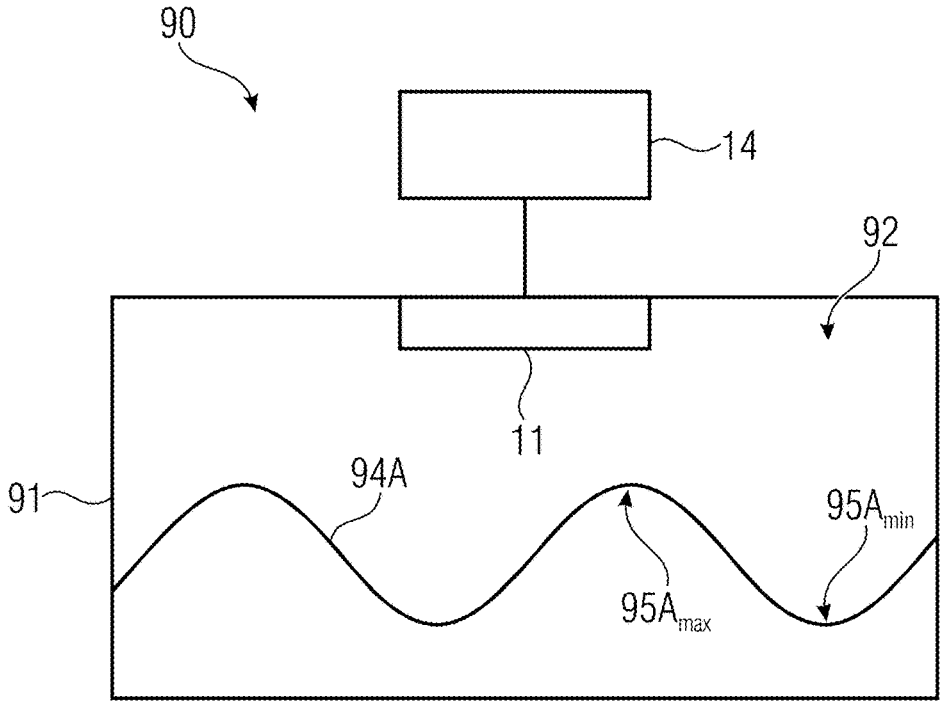
FIG. 9A shows a schematic view of a system according to the invention with a device according to the invention, which is operated in a first feeding configuration.
Figure 9B:
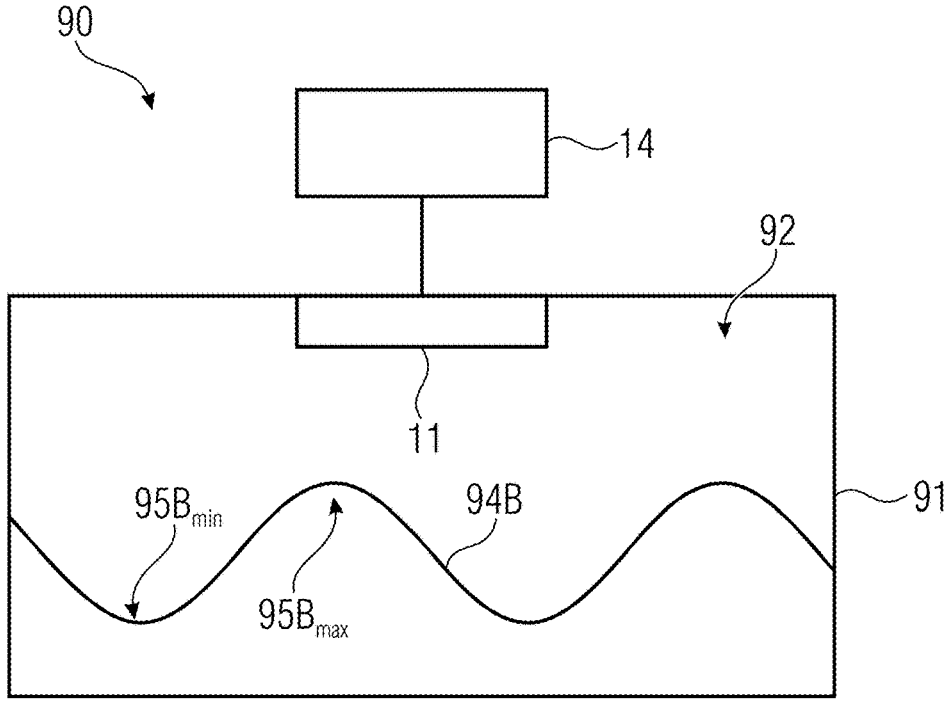
FIG. 9B shows a schematic view of a system according to the invention with a device according to the invention, which is operated in a second feeding configuration.

FIGS. 9A and 9B show embodiments of a system 90 according to the invention which, among other things, exhibits the previously described antenna array 11 as well as the associated control device 14. The system 90 further exhibits a three-dimensional body 91 comprising at least one recess 92 within which electromagnetic waves 94A, 94B emitted by the antenna array 11 propagate.

The three-dimensional body 91, for example, can be a housing. The interior 92 of the three-dimensional body 91 may exhibit a shielding at least in sections to reduce radiation escaping to the outside. This shielding may, for example, comprise metal, and may, for example, be provided in the form of a metallic coating which is arranged at least in sections on at least one inner wall of the three-dimensional body 91. Alternatively or additionally, the three-dimensional body 91 can comprise metal or consist of metal.

The antenna array 11 is arranged immovably on the three-dimensional body 91. This means that, in contrast to conventional technology, the antenna array 11, or the individual antennas $\mathbf{12}_1$, $\mathbf{12}_2$, $\mathbf{12}_3$, $\mathbf{12}_4$ of the antenna array 11, are immovable in relation to the three-dimensional body 91.

The antenna array 11 can, as shown in FIGS. 9A and 9B, be arranged within the three-dimensional body 91 or in the recess 92 of the three-dimensional body 91. Alternatively, the antenna array 11 may be arranged externally on the three-dimensional body 91, wherein in this case the antenna array 11 should be arranged on the three-dimensional body 91 such that the electromagnetic waves propagate into the recess 92 of the three-dimensional body 91.

FIG. 9A shows the system 90 just described, wherein the control device 14 provides a first feeding configuration so that the antenna array 11 exhibits a first radiation pattern. In this first feeding configuration, the individual antennas $\mathbf{12}_1$, $\mathbf{12}_2$, $\mathbf{12}_3$, $\mathbf{12}_4$ are controlled or fed in such a way that the antenna array 11 emits polarized waves. The standing wave 94A, or mode, shown in FIG. 9A can thereby form in the recess 92 of the three-dimensional body 91.

FIG. 9B shows the same system 90, wherein the control device 14 provides a second feeding configuration according to the invention so that the antenna array 11 has a second radiation pattern. In this second feeding configuration, the individual antennas $\mathbf{12}_1$, $\mathbf{12}_2$, $\mathbf{12}_3$, $\mathbf{12}_4$ are controlled or fed in such a way that the antenna array 11 emits positively or negatively depolarized waves according to the invention. The standing wave 94B, or mode, shown in FIG. 9B can thereby form in the recess 92 of the three-dimensional body 91.

As can be seen in the comparison of FIGS. 9A and 9B, the local maxima $\mathbf{95}A_{Max}$, $\mathbf{95}B_{Max}$ and minima $\mathbf{95}A_{Min}$, $\mathbf{95}B_{Min}$ of the respectively forming mode 94A, 94B shift. In the extreme case only exemplarily illustrated here, the modes 94A, 94B shift in such a way that at the locations where a maximum of $\mathbf{95}A_{Max}$ prevails in the first feeding configuration (FIG. 9A), a minimum of $\mathbf{95}B_{Min}$ occurs in the second feeding configuration (FIG. 9B), and vice versa.

In the following, the concept according to the invention shall be summarized again in other words:

Within a closed or almost closed environment, where standing waves can form, an antenna array 11 (e.g. array 11 with patch antennas $\mathbf{12}_1$, $\mathbf{12}_2$, $\mathbf{12}_3$, $\mathbf{12}_4$) with the arrangement 2×2 (FIG. 2B), 2×4 (FIG. 2C), 4×2 (FIG. 2D), 4×4 (FIG. 2E) or further corresponding multiples is mounted. For the further course, the arrangement 2×2 is considered, since everything else represents a parallelization of this arrangement. Antenna arrays 11 are well known from antenna technology. Feed networks are dimensioned to define specific polarities or antenna lobes. The invention is based on the fact that a configuration of the feed network is used as it is avoided in conventional technology.

State of the art: In order to generate a left or right circular field with a 2×2 antenna array and feed network, it is useful to place the feeder ports of the individual antennas $12_1$, $12_2$, $12_3$, $12_4$ of the antenna array 11 with a geometric angle difference of 90° to one another. In addition, it is useful for the individual antennas $12_1$, $12_2$, $12_3$, $12_4$ to be electrically controlled with the same power and additionally with a phase difference of +90° or −90° to one another so that the summation of the emitted field components results in a left or right circularly polarized field. An exemplary preset feed network is shown in FIG. 3B.

The different feeding configurations are shown in FIGS. 4A and 4B. An above mentioned feeding configuration according to conventional technology (polarized) results, for example, with an arrangement via path ①, wherein a left circularly polarized field is generated, and with an arrangement via path ②, wherein a right circularly polarized field is generated.

In addition, by using phase actuators 41 and amplitude actuators 44, it is possible in such an arrangement to polarize the antennas $12_1$, $12_2$, $12_3$, $12_4$ elliptically, circularly, horizontally/vertically linearly, depending on the preset phase/amplitude control. These arrangements have in common that in the ideal case, they have their maximum field $52_{Max}$ in the center of the antenna array 11, see FIGS. 5A and 6A. The elliptical polarization is the normal state with the extremes of circular polarization on one side and linear polarization on the other.

The inventive idea now is to construct the antenna array 11 geometrically as described above and to control the individual antennas $12_1$, $12_2$, $12_3$, $12_4$ of the array 11 with 0° phase difference to one another (and optionally the same power). This inventive feeding configuration is shown in FIGS. 4A and 4B by means of the paths ③ (positively depolarized) and ④ (negatively depolarized).

In this control configuration, there is a minimum of $52_{Min}$ in the center of the antenna array 11 in contrast to conventional technology, see FIGS. 5B and 6B.

If it is switched between the depolarized state according to the invention (positively or negatively) and at least one of the different elliptical polarizations, there is a shift in the center of the antenna array 11 between minimum $52_{Min}$ and maximum $52_{Max}$, see FIGS. 5A and 5B, as well as FIGS. 6A and 6B. This results in a reverberation/displacement of the forming modes 94A, 94B in a closed or almost closed (metallic) environment, see FIGS. 9A and 9B.

With regard to temporal behavior, there are several possibilities: A) switching between the states so fast that no modes form, B) switching through so slowly that modes form and shift with the new polarization via switching.

Further possibilities for the reverberation of the modes result from corresponding combinations of phases and power control of the individual antennas $12_1$, $12_2$, $12_3$, $12_4$ in the antenna array 11. FIGS. 4A and 4B exemplarily show an analog implementation (antenna integration possible). This is also possible directly via digital signal generation/signal processing, e.g. in an RFID reader 73, see FIG. 7.

Via the phases and amplitude actuators 41, 44, the reverberation of modes (e.g. in a metallic environment) can be additionally supported by beamforming. Furthermore, the modes 94A, 94B can be directed and formed via non-synchronous phases and amplitude control of the individual radiators $12_1$, $12_2$, $12_3$, $12_4$. Single radiators $12_1$, $12_2$, $12_3$, $12_4$ can be switched off and on again for the reverberation of modes.

The phase/amplitude setting can be realized permanently (FIGS. 4A, 4B) or variably (Figure B) or digitally (FIG. 7).

In parallel, the frequency can be shifted over the bandwidth of the antennas $12_1$, $12_2$, $12_3$, $12_4$ to influence the formation of the modes 94A, 94B.

With the method according to the invention or with the arrangement according to the invention, for example, the simple reading of transponders in a metal environment can be made possible. Non-limiting examples of this would be surgical instruments in autoclaves, logistics transponders in a tunnel gate, etc.

The individual radiators $12_1$, $12_2$, $12_3$, $12_4$ can exhibit a distance of A or broken lambda multiples.

Generation of an electrical reverberation of modes within the feed network/digital signal processing results in several advantages:

- reading of chaotically arranged transponders within a closed metallic environment,
- faster handling and process acceleration, for example, in the field of disinfection/sterilization of surgical instruments/packing the sieve
- check for completeness
- less complex than conventional technology
- fewer antennas->less costs and cabling effort
- no mechanics/rotating parts, therefore no maintenance costs
- cheaper than prior art
- adaptable to other applications than surgical instruments, e.g. tools
- Targeted shift of the minima & maxima of standing waves->significant increase of bulk reading capability for RFID systems in metallic environments.

Applications may be:

- RFID bulk reading
- surgical instruments identification during sterilization/disinfection (autoclave).
- tool identification
- sensor transponders in ovens/convection ovens
- transponder reading device for metallic environment where standing waves are formed, e.g. tunnel gate Although some aspects have been described in connection with a device, it goes without saying that these aspects also represent a description of the corresponding method so that a block or component of a device is also to be understood as a corresponding method step or as a feature of a method step. By analogy, aspects described in conjunction with or as a method step also represent a description of a corresponding block or detail or feature of a corresponding device.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Device comprising an antenna array comprising at least four antennas arranged to be offset from one another, each antenna comprising a feeder line terminal of its own, wherein those feeder line terminals of each of the at least four antennas, which are arranged to be directly adjacent to one another, exhibit a mutual geometric offset of 90°, respectively, a control device configured to feed each of the at least four antennas via their respective feeder line terminal, so that the antenna array exhibits different radiation patterns at different points in time, a first radiation pattern comprising a polarized field distribution, and a second radiation pattern comprising an unpolarized field distribution.

2. Device as claimed in claim 1, wherein the control device is configured to feed each of the at least four antennas, within a first time interval, such that the antenna array exhibits the first radiation pattern, and to feed the individual antennas, within a second time interval, such that the antenna array exhibits the second radiation pattern, and wherein the control device is configured to switch back and forth between the first and second radiation patterns at least once.

3. Device as claimed in claim 2, wherein the control device is configured to switch so slowly between the first and second radiation pattern that modes are formed in a space surrounding the radiation of the antenna array, wherein the modes forming at the first radiation pattern differ from the modes forming at the second radiation pattern such that a mode reverberation occurs in the space surrounding the radiation of the antenna array due to the switching back and forth.

4. Device as claimed in claim 2, wherein the control device is configured to switch back and forth between the first and second radiation pattern so fast that no modes are formed in a space surrounding the radiation of the antenna array.

5. Device as claimed in claim 1, wherein the first radiation pattern exhibits a first field distribution and the second radiation pattern exhibits a second field distribution, wherein the first field distribution at the center of the antenna array exhibits a greater field strength than the second field distribution.

6. Device as claimed in claim 1, wherein the first radiation pattern exhibits a first field distribution which exhibits a maximum field strength in the center of the antenna array, and wherein the second radiation pattern exhibits a second field distribution which exhibits a minimum field strength in the center of the antenna array.

7. Device as claimed in claim 1, wherein the control device is configured to feed, in a first feeding configuration, each of the at least four antennas arranged in a feed network such that the antenna array exhibits the first radiation pattern, wherein the control device is configured to feed each of the at least four antennas with one feeder signal in each case, wherein the feed network exhibits a preset phase difference $\Delta\varphi$ according to which feeder signals that are fed into the respective at least four antennas each exhibit a phase offset of $\Delta\varphi=\pm 90°$ to one another.

8. Device as claimed in claim 1, wherein the control device is configured to feed, in a second feeding configuration, each of the at least four antennas arranged in a feed network in such a way that the antenna array exhibits the second radiation pattern, wherein the control device is configured to feed each one of the least four antennas with a respective feeder signal and to adapt the phase position of the respective feeder signals such that a preset phase difference $\Delta\varphi$ of the feed network is compensated.

9. Device as claimed in claim 8, wherein the control device is configured to feed, in the second feeding configuration, each of the at least four antennas in such a way that, relative to a reference phase of $\varphi=0°$ the phase position of the feeder signal fed into a first antenna ($\mathbf{12}_1$) is not rotated, the phase position of the feeder signal fed into a second antenna ($\mathbf{12}_2$) is rotated by a phase angle of 270°, relative to the reference phase of $\varphi$, the phase position of the feeder signal fed into a third antenna ($\mathbf{12}_3$) is rotated by a phase angle of 180°, relative to the reference phase of $\varphi$, and the phase position of the feeder signal fed into a fourth antenna ($\mathbf{12}_4$) is rotated by a phase angle of 90°, relative to the reference phase of $\varphi$, or wherein the control device is configured to feed each of the at least four antennas in the second feeding configuration such that, relative to a reference phase of $\varphi=180°$ the phase position of the feeder signal fed into the first antenna ($\mathbf{12}_1$) is rotated by a phase angle of 180°, relative to the reference phase of $\varphi$, the phase position of the feeder signal fed into the second antenna ($\mathbf{12}_2$) is rotated by a phase angle of 90°, relative to the reference phase of $\varphi$, the phase position of the feeder signal fed into the third antenna ($\mathbf{12}_3$) is not rotated, and the phase position of the feeder signal fed into the fourth antenna ($\mathbf{12}_4$) is rotated by a phase angle of 270°, relative to the reference phase of $\varphi$.

10. Device as claimed in claim 8, wherein the control device is configured to feed, in the second feeding configuration, each of the at least four antennas in such a way that, relative to a reference phase of $\varphi=0°$ the phase position of the feeder signal fed into first antenna ($\mathbf{12}_1$) is rotated by an offset angle $\varphi=x°$, relative to the reference phase of $\varphi$, the phase position of the feeder signal fed into a second antenna ($\mathbf{12}_2$) is rotated by a phase angle of $\varphi=270°$ plus the offset angle $\varphi=x°$, relative to the reference phase of $\varphi$, the phase position of the feeder signal fed into a third antenna ($\mathbf{12}_3$) is rotated by a phase angle of $\varphi=180°$ plus the offset angle $\varphi=x°$, relative to the reference phase of $\varphi$, and the phase position of the feeder signal fed into a fourth antenna ($\mathbf{12}_4$) is rotated by a phase angle of $\varphi=90°$ plus the same offset angle $\varphi=x°$, wherein the offset angle x° is: $0° \leq x° \leq 360°$.

11. Device as claimed in claim 1, wherein the control device is configured to feed each of the at least four antennas of the antenna array with equal power.

12. Device as claimed in claim 1, wherein the control device is configured to vary the frequency of a feeder signal coupled via the respective feeder line of a respective antenna within the bandwidth of the respective antenna.

13. Device as claimed in claim 1, wherein the control device is arranged to deactivate one or more antennas of the antenna array in a first time interval and to activate one or more of the deactivated antennas in a second time interval.

14. RFID-reader with a device comprising an antenna array comprising at least four antennas arranged to be offset from one another, each antenna comprising a feeder line terminal of its own, wherein the feeder line terminals of antennas which are arranged to be directly adjacent to one another exhibit a mutual geometric offset of 90°, respectively, a control device configured to feed each of the at least four antennas via their respective feeder line terminals, so that the antenna array exhibits different radiation patterns at different points in time, a first radiation pattern comprising a polarized field distribution, and a second radiation pattern comprising an unpolarized field distribution.

15. System with a device comprising an antenna array comprising at least four antennas arranged to be offset from one another, each antenna comprising a feeder line terminal of its own, wherein the feeder line terminals of antennas which are arranged to be directly adjacent to one another exhibit a mutual geometric offset of 90°, respectively, a control device configured to feed each of the at least four antennas via their respective feeder line terminals, so that the antenna array exhibits different radiation patterns at different points in time, a first radiation pattern comprising a polarized field distribution, and a second radiation pattern comprising an unpolarized field distribution, and with a three-dimensional body exhibiting at least one recess which defines a space within which the electromagnetic waves emitted by the antenna array propagate.

16. System as claimed in claim 15, wherein the recess exhibits a shielding configured to reduce the emission of electromagnetic waves from the recess.

17. System as claimed in claim 15, wherein the antenna array is immovably arranged within the recess, or wherein the antenna array is immovably arranged on the three-dimensional body such that electromagnetic waves propagate into the recess.

* * * * *